US008475277B2

(12) United States Patent
Palmisano et al.

(10) Patent No.: US 8,475,277 B2
(45) Date of Patent: Jul. 2, 2013

(54) SYSTEMS AND/OR METHODS FOR PLAYER-CONTROLLED PARTICIPATION IN RANDOM REWARDS

(75) Inventors: Angelo Palmisano, Crystal Lake, IL (US); Sam Johnson, Las Vegas, NV (US)

(73) Assignee: Paltronics, Inc., Crystal Lake, IL (US)

( * ) Notice: Subject to any disclaimer, the term of this patent is extended or adjusted under 35 U.S.C. 154(b) by 1263 days.

(21) Appl. No.: 11/979,418

(22) Filed: Nov. 2, 2007

(65) Prior Publication Data

US 2009/0117999 A1 May 7, 2009

(51) Int. Cl.
*A63F 9/24* (2006.01)

(52) U.S. Cl.
USPC ..... 463/42; 463/20; 463/27; 463/30; 463/43

(58) Field of Classification Search
USPC ..... 463/20, 27, 30, 42, 43
See application file for complete search history.

(56) References Cited

U.S. PATENT DOCUMENTS 6,626,758 B1 9/2003 Parham et al.
7,841,939 B2 * 11/2010 Baerlocher et al. ..... 463/25
7,862,427 B2 * 1/2011 Nguyen et al. ..... 463/27
7,883,407 B2 * 2/2011 Johnson ..... 463/20
7,905,778 B2 * 3/2011 Breckner et al. ..... 463/26
2009/0048014 A1 2/2009 Palmisano
2009/0048015 A1 2/2009 Palmisano
2009/0117969 A1 * 5/2009 Englman ..... 463/20
2009/0197684 A1 * 8/2009 Arezina et al. ..... 463/42
2010/0210348 A1 * 8/2010 Peterson ..... 463/20
2010/0291991 A1 * 11/2010 Baerlocher et al. ..... 463/20
2011/0003642 A1 * 1/2011 Russell et al. ..... 463/42

OTHER PUBLICATIONS

U.S. Appl. No. 11/889,970 of Palmisano, filed Aug. 17, 2007.
U.S. Appl. No. 11/889,971 of Palmisano, filed Aug. 17, 2007.

* cited by examiner

*Primary Examiner* — Pierre Eddy Elisca
*Assistant Examiner* — Shahid Kamal

(57) ABSTRACT

Certain exemplary embodiments described herein relate to gaming machines and/or table games having interfaces provided thereto so as to allow players to control their participation in base games and random rewards scenarios. More particularly, an interface provided to the gaming machines and/or table games enables separate and/or separable credit meters to be maintained such that players may determine whether, and to what extent, to allocate credits to base games and one or more random rewards scenarios. This advantageously provides players with further control over their gaming opportunities. Also, certain exemplary embodiments may enable players to wager credits in excess of those capped by a particular gaming machine or table game. This advantageously provides additional revenue possibilities for gaming operators.

24 Claims, 14 Drawing Sheets

SYSTEMS AND/OR METHODS FOR PLAYER-CONTROLLED PARTICIPATION IN RANDOM REWARDS

TECHNICAL FIELD

The exemplary embodiments described herein relate to gaming machines and/or table games used within a gaming environment and, more particularly, to gaming machines and/or table games having interfaces provided thereto so as to allow players to control their participation in base games and random rewards scenarios. In certain exemplary embodiments, the interface enables separate and/or separable credit meters to be maintained such that players may determine whether, and to what extent, to allocate credits to base games and one or more random rewards scenarios, thereby advantageously providing players with further control over their gaming opportunities. Certain exemplary embodiments may enable players to wager credits in excess of those capped by a particular gaming machine or table game, advantageously providing additional revenue possibilities for gaming operators.

BACKGROUND AND SUMMARY

For years, gaming machines (e.g., of the type typically found in casinos, on riverboats, and/or in other gambling establishments) have provided patrons or players with enjoyment and proprietors with revenue. Broadly speaking, they have evolved from simple, classic slot machines featuring mechanical arms that a player would pull, to more complicated video-based versions of slots, poker, and other games, with one or more buttons sometimes replacing the functions served by the mechanical arm. Further changes have included, for example, incorporating multiple displays to support advertising and/or sometimes even additional games.

As the desire for more engaging entertainment has increased yet further, some providers began configuring their gaming machines for use in a networked environment. This arrangement, in turn, has enabled some game providers to offer "random rewards" for players using gaming machines. Generally speaking, such random rewards enable players who initiate a wager to become eligible to win one or more randomly selected monetary percentages as a function of a random number of an entire fixed or progressive prize pool, with or without regard to game outcome. Techniques associated with providing random rewards are disclosed, for example, in U.S. Pat. No. 6,626,758, the entire contents of which are hereby incorporated herein by reference.

Current random rewards programs utilize a fixed number of credits drawn from the same credit meter as the existing base game. That is, if the player bets X credits, Y credits (which may or may not be a number of credits configurable by the proprietor of the gaming establishment) of those X credits generally will always be dedicated to the random rewards prize pool. Y typically is equal to 1, although sometimes another number of credits may be dedicated to the random rewards program (typically with $Y \leqq X-1$). For example, in a typical random rewards scenario, if the player wagers 3 credits, 2 credits are dedicated to the base game and the remaining credits are dedicated to the random rewards prize pool. When a player selects the "MAX BET" feature of a game, depending on the implementation, all X credits are provided to the base game with no credits being provided to the random rewards prize pool, or Y credits are distributed to the random rewards prize pool as normal.

Although random rewards prize generation has represented an advancement in the gaming arts, further enhancements are still possible. For example, players may feel a sense of excitement when they or those around them win a random reward. However, they do not experience the related, precursor excitement of participating in—or really "playing"—the random rewards program. This is caused in part because there typically is no indication as to when a random reward will come, what form the random reward will come in, and sometimes whether the random reward exists at all. Similarly, players may have no sense that they are entering into a random rewards pool or that they are participating in "game" separate than that provided to the gaming machine itself, at least until—or sometimes even when—a prize is rewarded.

Players have, and may perceive, a reduced amount of control as to how their credits are allocated. That is, players can only provide credits to the base game via the fixed, standard gaming interface. They therefore have no control over whether and to what extent they wish to participate in a random rewards program or multiple random rewards programs, other than the trivial control of sitting at a machine marketed as being eligible for random rewards.

Similarly, particularly with progressive-based games, player participation is tied to individual player performance and/or habits (e.g., amounts wagered, time spent in casinos, etc.), typically as tracked via a player card that interacts with a player tracking system. Known player tracking systems provide multiple levels (e.g., four levels) of progressive-based game participation. However, the level of participation is determined for the player on behalf of the player based on predefined characteristics of the player—thus, the level of participation is not customizable by, or necessarily even known to, the player.

There are also revenue-related drawbacks for proprietors. For example, the revenue (and often the prize pool) for random rewards programs for proprietors is based on a fixed percentage of the credits "bet." That is, revenue for the random rewards program is based on the Y credits of the total bet dedicated to the random rewards program and the "bet" does not exceed the X credits specified by the gaming machine. Thus, proprietors cannot realize incremental additional credits from random rewards programs, which would be separate from revenue dedicated to the base game. Accordingly, although proprietors are not losing money, per se, current arrangements foreclose the chance to earn additional credits from people that might be willing to contribute to random rewards jackpots independent of base games. Oftentimes, this is a limitation of using the base game itself as the payment collector with no way of using it in more advanced ways.

Similarly, random rewards programs generally are provided only to gaming machine players using suitably equipped gaming machines because that is where the infrastructure for accepting payment and providing the rather limited user interfaces exists. Thus, random rewards programs are not provided to, for example, other gaming machines, table games, roulette tables, etc. Although existing gaming machines allow players to play one or more games (e.g., a gaming machine may enable a player to play "Jacks or Better," "Deuces Wild," etc.), they can do so only one at a time and/or using the funds of a single credit meter.

Thus, it will be appreciated that there is a need in the art for overcoming one or more of these and/or other disadvantages, and/or for providing improvements to existing random rewards programs.

In certain exemplary embodiments, a gaming device for use in a networked gaming environment is provided. The networked gaming environment includes a jackpot controller configured to calculate and disburse payouts for a base game playable by the gaming device, and a random rewards jackpot controller configured to calculate and disburse payouts for at least one predefined random rewards scenario available to the gaming device. On the gaming device, at least one display is configured to display a base game provided to the gaming device. A payment acceptor is configured to receive a form of payment from a player in exchange for credits usable on the gaming device. A random rewards machine controller is configured to enable the player to allocate credits between a base game credit meter and a random rewards credit meter. The base game credit meter represents credits usable in connection with the base game, and the random rewards credit meter represents credits usable in connection with at least one random rewards pool corresponding to one said random rewards scenario. The at least one random rewards scenario is independent of the base game. A number of credits contributable to the base game from the base game credit meter is independent of a number of credits contributable to the at least one random rewards scenario from the random rewards credit meter. Payouts for the at least one random rewards scenario are disbursable independent of payouts for the base game.

In certain exemplary embodiments, a method of playing a gaming device connected in a networked gaming environment is provided. A base game playable by the gaming device is provided, with the base game being configured to award credits to the gaming device in dependence on a signal received from a jackpot controller connected in the networked gaming environment. At least one random rewards scenario that is enterable by the gaming device is provided, with the at least one random rewards scenario being configured to award credits to the gaming device in dependence on a signal received from a random rewards jackpot controller connected in the networked gaming environment. The base game is displayed on a display of the gaming device. A form of payment is received from a payment acceptor in exchange for credits usable on the gaming device. Credits are allocated between a base game credit meter and a random rewards credit meter in dependence on input received from a player of the gaming device, with the base game credit meter representing credits usable in connection with the base game and with the random rewards credit meter representing credits to be contributed to at least one random rewards pool corresponding to one said random rewards scenario. The at least one random rewards scenario is independent of the base game. A number of credits contributable to the base game from the base game credit meter is independent of a number of credits contributable to the at least one random rewards scenario from the random rewards credit meter. Payouts for the at least one random rewards scenario are disbursable independent of payouts for the base game.

In certain exemplary embodiments, a networked gaming environment is provided. The networked gaming environment includes a plurality of gaming devices comprising gaming machines and/or table games. A jackpot controller is configured to calculate and disburse payouts for a base game playable by at least some of the gaming devices. A random rewards jackpot controller is configured to calculate and disburse payouts for at least one predefined random rewards scenario available to at least some of the gaming devices. Payouts for the at least one random rewards scenario are disbursable independent of payouts for the base game. Each said gaming device comprises at least one display configured to display a base game provided to the gaming device; a payment acceptor configured to receive a form of payment from a player in exchange for credits usable on the gaming device; and a random rewards machine controller configured to enable the player of the gaming device to allocate credits between a base game credit meter and a random rewards credit meter, with the base game credit meter representing credits usable in connection with the base game and with the random rewards credit meter representing credits usable in connection with at least one random rewards pool corresponding to one said random rewards scenario. The at least one random rewards scenario is independent of the base game. A number of credits contributable to the respective base game from the base game credit meter is independent of a number of credits contributable to the at least one random rewards scenario from the random rewards credit meter.

In certain exemplary embodiments, a method of managing a plurality of credit meters provided to a gaming device is provided. A first credit meter is provided, with said first credit meter being configured to provide credits to a base game playable via the gaming device. At least one secondary service accessible via the gaming device is defined. At least one second credit meter is provided, with each said second credit meter being associated with one said secondary service such that a secondary service is fundable with credits only from its respective second credit meter. Credits are distributed among the plurality of credit meters based on patron input to the gaming device.

These exemplary features, aspects, and advantages may be combined in various combinations and ways to achieve yet further embodiments.

BRIEF DESCRIPTION OF THE DRAWINGS

These and other features, aspects, and advantages will be better and more completely understood by reference to the following detailed description of exemplary illustrative embodiments in conjunction with the drawings, of which.

DETAILED DESCRIPTION

The exemplary embodiments described herein relate to gaming machines and/or table games used within a gaming environment and, more particularly, to gaming machines and/or table games having interfaces provided thereto so as to allow players to control their participation in base games and random rewards scenarios. An interface provided to the gaming machines and/or table games enables separate and/or separable credit meters to be maintained such that players may determine whether, and to what extent, to allocate credits to base games and one or more random rewards scenarios. This advantageously provides players with further control over their gaming opportunities. Also, certain exemplary embodiments may enable players to wager credits in excess of those capped by a particular gaming machine or table game. This advantageously provides additional revenue possibilities for gaming operators.

Figure 1:
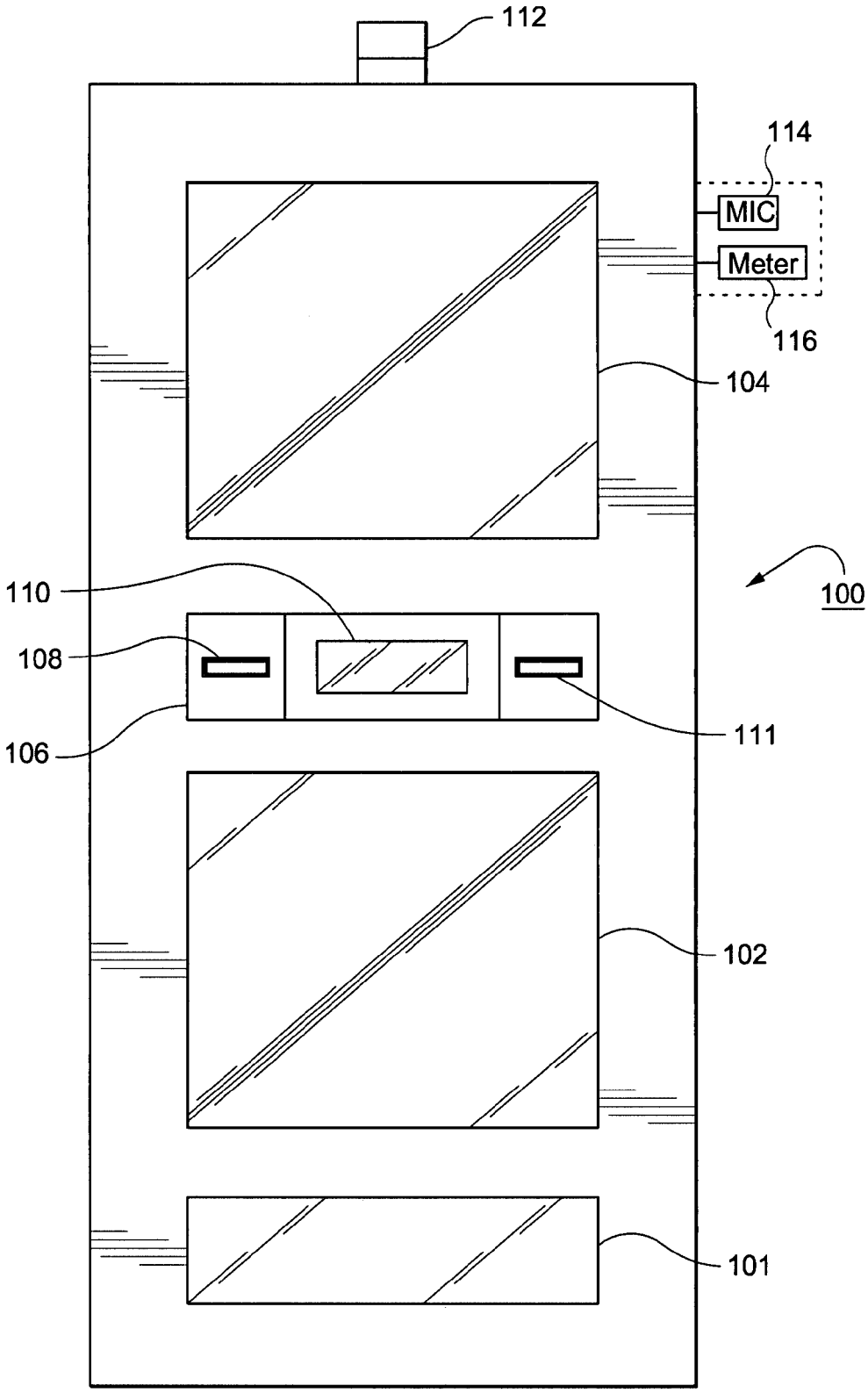
FIG. 1 is a current gaming machine for use with a current gaming network of the type typically used in casinos.
Figure 2:
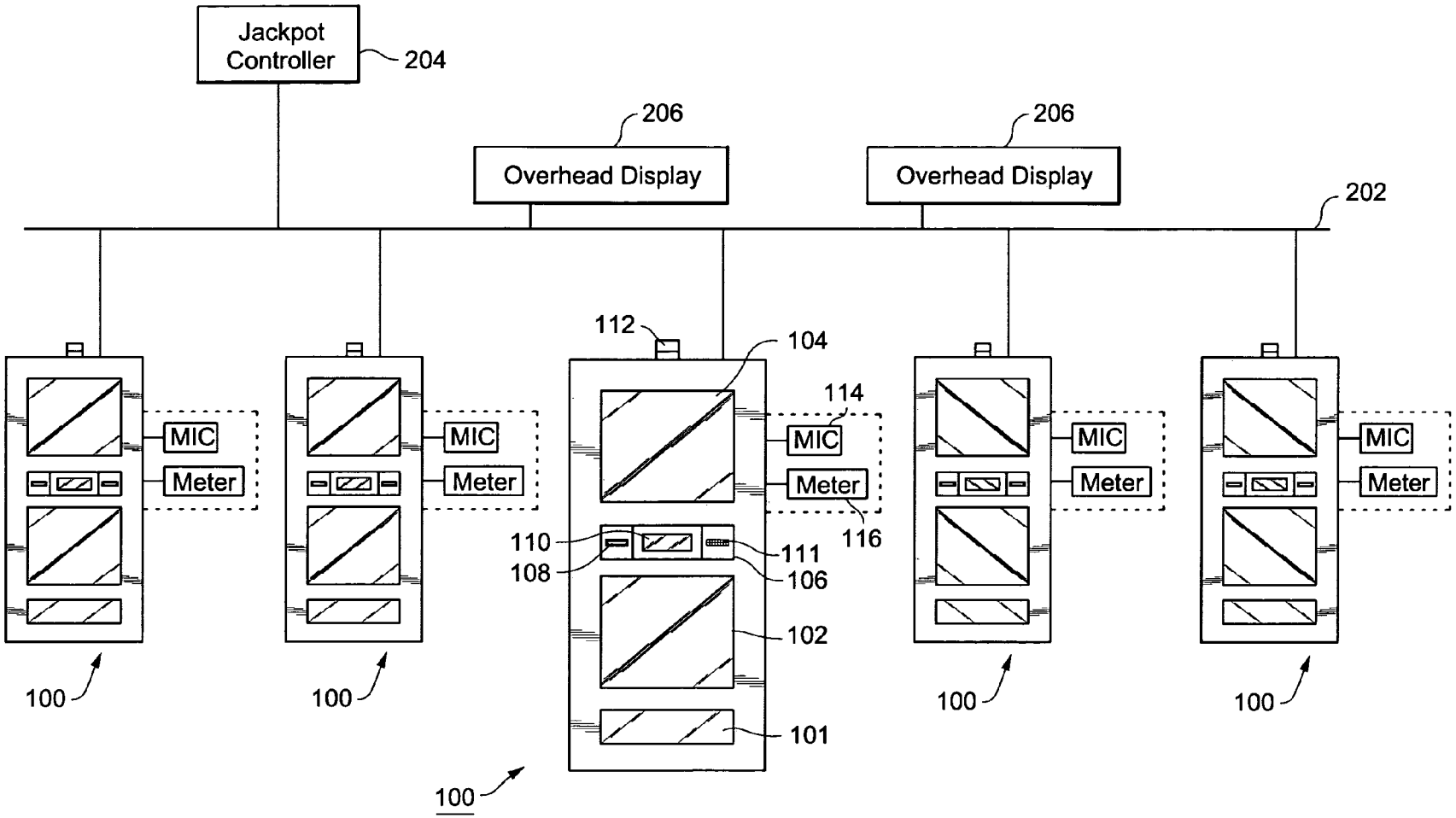
FIG. 2 shows a plurality of gaming machines and associated peripherals being located on a casino floor and being connected in a networked environment.

Referring now more particularly to the drawings, FIG. 1 is a current gaming machine 100 for use with a current gaming network of the type typically used in casinos, and FIG. 2 shows a plurality of gaming machines 100 and associated peripherals being located on a casino floor and being connected in a networked environment. For aesthetic purposes, belly glass 101 often is provided on gaming machines. Each gaming machine includes a first display area 102, generally referred to as a game screen. The game screen 102 traditionally has been where most of the "action" happens. For example, the game screen 102 may simulate the rolling of the reels on a slot machine and thus indicate whether the player has won any money. A second display area 104, generally referred to as a top box, also is provided. The top box 104 may display additional information for the player, such as, for example, advertising, generally entertaining animations, bonus game opportunities, etc.

The game screen 102 and/or the top box 104 may be touch screen monitors and thus accept input directly. Such input may pertain to, for example, the number of credits to bet, the way in which a bet may be made, whether to initiate a bet, whether to cash out, etc. In other cases, a separate control panel (not shown) may be provided to enable the same and/or similar functionality.

The gaming machine 100 also is provided with a player tracking module (PTM) area 106. The PTM area 106 includes a payment acceptor (e.g., a card reader, a coin and/or dollar acceptor, etc.) 108 to accept payment (e.g., cash, an encoded card storing credits or linked to a database with credit information, or the like) from the player. A small display screen (or PTM) 110 is located in the PTM area 106 and enables the player to access certain other more individualized services. For example, the PTM 110 may enable the player to call an attendant to order drinks. In such a case, the PTM 110 may cause the candle 112 (e.g., one or more differently colored lights) of the gaming machine 100 to become lit to signal to casino personnel that the player is requesting some form of service. The PTM 110 typically is an LCD screen and typically is operated using control panel 111.

The PTM 110 may have a computer-readable storage medium (not shown) associated therewith. The computer-readable storage medium typically is a small flash drive, hard drive, or other suitable memory location. Information may be distributed to the PTM 110 and at least temporarily stored on the computer-readable storage medium. In this way, it is possible to provide some media offerings to the gaming machine 100 for display by the PTM 110. More particularly, the computer-readable storage medium is used as a buffer for the media offerings that ultimately may be displayed by the PTM 110.

The game screen 102 and the top box 104, and the respective associated circuitry, typically are provided by a single company. The PTM 110 often is provided by another vendor. Sometimes, the PTM 110 will be integrated into the gaming machine 100. However, it is often the case that the gaming machine 100 will be retrofitted with a PTM 110. As such, the hardware and software systems for the game screen 102 and the top box 104 typically are independent of the hardware and software systems for the PTM 110.

This separation often makes integration between the various components cumbersome. Thus, to accommodate these features related to the PTM area 106, gaming machines are equipped with special purpose hardware to facilitate this and/or similar arrangements. It will be appreciated that the player management tracking and information management features provided typically exist outside of the normal base game(s) environment, which deal directly with game play rather than ancillary services, patron interaction, feedback, and the like.

It will be appreciated that although the gaming machines 100 shown in FIG. 2 all appear the same, the present invention is not so limited. A wide variety of gaming machines may be provided, as may table games, roulette tables, etc. Variations to each may include changes in terms of configuration, style, type, functionality, payouts, etc.

In many cases, an RS-485 connection is utilized. The connection often is to a machine interface card (or MIC) 114 located within each gaming machine. In essence, the MIC 114 translates between the gaming machine 100 and the network 202, making all such gaming machines appear to be the same from the perspective of the network 202.

As alluded to above, a plurality of gaming machines 100 may be located on a casino floor and be connected in a networked environment, e.g., via network 202. To this end, a plurality of central systems (not shown) are connected to the networked environment to collect and/or distribute data, as necessary. Each gaming machine 100 may be connected to one or more of the central systems via a network link. Such network links typically are proprietary and are based on unicast, broadcast, multi-drop, and/or other suitable network protocols. Although proprietary protocols often are implemented, the typical effect is that data is transmitted to/from the central systems over a broadcast channel or to one or more targeted groups (e.g., a bank of gaming machines in a row, in a particular area of the gaming floor, etc.) over connections.

There are at least three separate systems or modules comprising the central systems. A first system, management and accounting subsystem, provides management and accounting functions, also sometimes called auditing functions. Typically, these functions gather and/or report coin-in and coin-out operations, door openings (e.g., when a gaming machine is serviced), service cycles in general, ticket replacements, and the like. This activity generally is linked to the game being played on the gaming machine and/or the gaming machine itself.

A second system, player tracking subsystem, provides player tracking functions. More specifically, such systems link players on the gaming floor to particular activities undertaken by the players on the gaming floor. The information typically tracked for each player includes, for example, the session of game play (e.g., date, time, location, type of machine, type of game, etc.) as well as the individual's profile (e.g., name, address, and/or other identifying information such as hair color). The player tracking subsystem also may interface with the PTM 110 of a particular gaming machine 100.

A third system, bonusing subsystem, provides enhancements which may or may not be related to the base game. Such enhancements may relate to bonusing, progressive games, mystery, secondary games, random rewards (e.g., as disclosed in U.S. Pat. No. 6,626,758), etc. This system typically interfaces with the PTM 110.

Other systems may be included in the central systems. For example, other modules may be provided for detecting cash-in, cash-out, and/or data mining purposes. Data mining may be used, for example, in connection with marketing activities, accounting and/or auditing activities, etc.

Reports may be generated by the central systems, for example, to report on earnings, operational efficiencies, repairs, etc. Such reports also may be the result of the above-described data mining operations.

An in-machine meter 116 may be provided to the gaming machines 100 to cooperate with the central systems (e.g., to provide information regarding game plays, amounts of wagers, payoffs, etc.).

In addition to the gaming machines 100 existing in the network, one or more overhead displays 206 may be connected to the network 1118. The overhead displays 206 may receive data from the central systems indicating, for example, the jackpot amount(s) (e.g., current, daily, monthly, etc.), payouts (e.g., current, daily, monthly, etc.), winners, etc.

A jackpot controller 204 also is connected to the network 202. A single jackpot controller may be assigned to a bank of gaming machines 100. Typically, a jackpot controller is configured to accept a single bank of up to 124 gaming machines. The jackpot controller 204 may be responsible for calculating jackpots, changing the turnover on every hit and/or on every play, returning the winning amounts, etc. The jackpot controller 204 may be a progressive jackpot controller or it may be a non-progressive jackpot controller. Alternatively, multiple jackpot controllers 204 may be used within a single bank or among multiple banks. For example, separate jackpot controllers 204 may be respectively responsible for progressive and non-progressive jackpots. In still other alternate arrangements, multiple instances running on one or more jackpot controllers 204 may be dedicated to various banks of gaming machines, progressive and/or non-progressive jackpots, etc. In still other alternative arrangements, jackpot controllers may be installed in each machine individually, so that the need for a network connection is reduced (e.g., sometimes even eliminated) and so that base games can be played on gaming machines in a more "stand-alone" arrangement.

Certain exemplary embodiments enable a player to opt to participate in one or more random rewards scenarios. The player uses a user interface provided to a display of the gaming machine to distribute available credits among the base game(s) and/or the random rewards scenario(s). Unlike conventional gaming machines and/or random rewards scenarios, the player in certain exemplary embodiments thus has to decide whether, and to what extent, to fund a specific account to be eligible for a random reward. Such funds or contributions in these exemplary implementations therefore would not come as a percentage of the players base bet. Rather, they would be incremental, somewhat like a "6th coin" provided to a 5-coin max bet system. Moreover, in certain exemplary embodiments, the funds may come from a separate or at least separable bank or credit meter that is not the same bank or credit meter as that used for the base game (where only a small percentage of each bet typically is what is contributed to the random rewards pool), or at least is represented in a way different from the credit meter of the base game. The credit meter from which credits are drawn when a player opts to participate in any one of the random jackpots that are separate or at least separable from the base game is termed a random reward credit meter (RRCM) for convenience, and the player has to fund this credit meter in certain exemplary embodiments. Thus, for example, 100% of the contributions made to the random rewards may be made by the player from an RRCM rather than from a configurable percentage as in typical progressive pools. This system serves the business goal of creating a means for incremental revenue for the casino operator rather than taking a percentage of the players' existing bets to fund the jackpot, all within a random rewards scenario. It also enables a player to select the level of participation, particularly in progressive-based games and/or random rewards scenarios.

Optionally, in certain exemplary embodiments, multiple RRCMs may be provided, for example, when there are multiple random rewards scenarios, whereas in certain other exemplary embodiments a first credit meter may be provided for the base game and a second credit meter may be provided for all random rewards scenarios. Although this discussion has focused on the possible implementation of multiple credit meters (e.g., a first credit meter for the base game and one or more second credit meters for the random rewards scenarios), it will be appreciated that the functionality may be accomplished using a single credit meter in the machine represented as multiple separate credit meters to programmed logic circuitry provided to the gaming machine. Thus, certain exemplary embodiments may implement "virtual" credit meters, in the sense that the distribution of credits is represented virtually or in a memory rather than among separate physical banks of credits. This arrangement may incorporate a single payment acceptor or multiple payment acceptors to fund such virtual credit meters.

Figure 3:
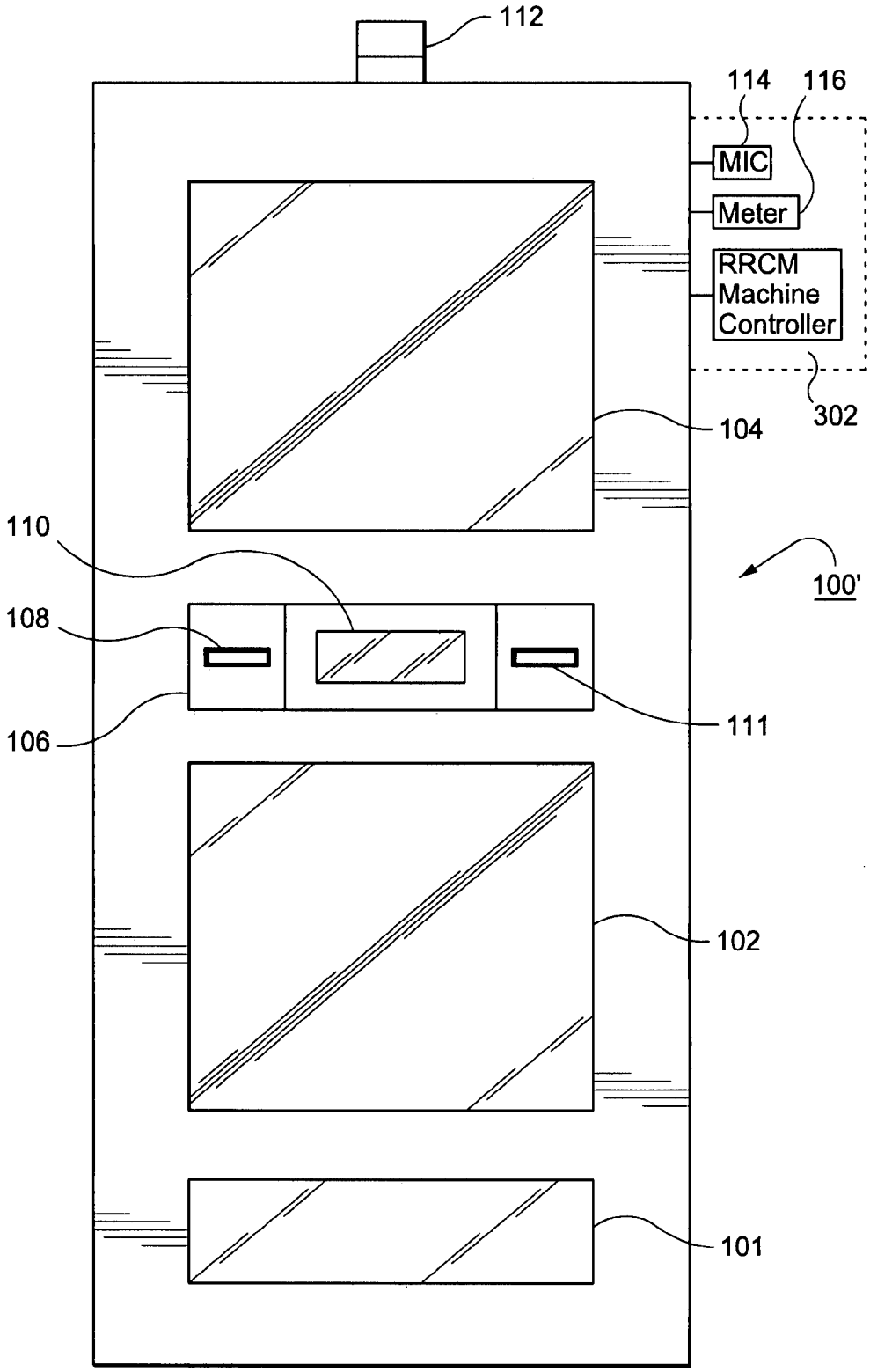
FIG. 3 is an improved gaming machine in accordance with an exemplary embodiment.
Figure 4:
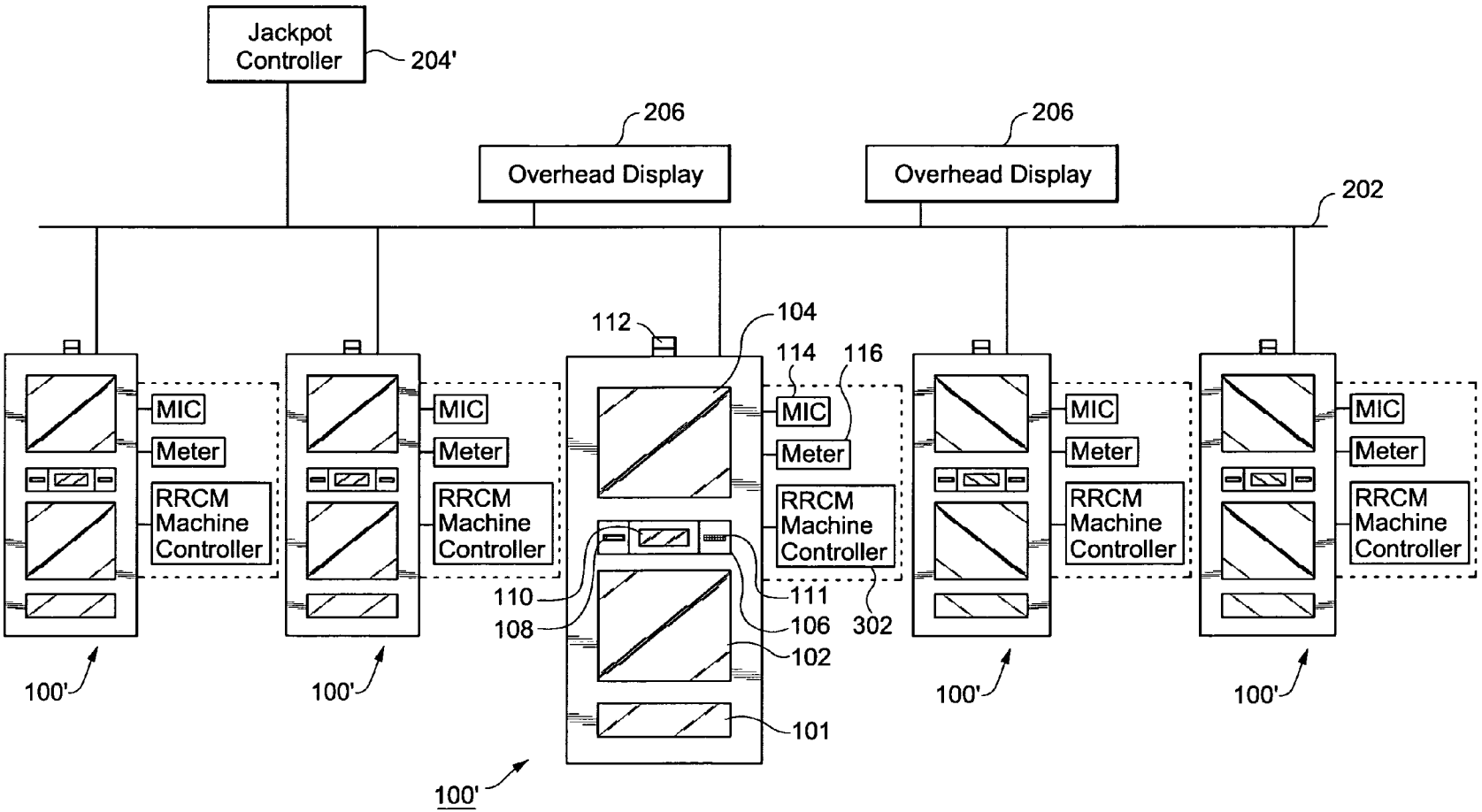
FIG. 4 shows a plurality of improved gaming machines and associated peripherals located on a casino floor and being connected in a network environment in accordance with an exemplary embodiment.

In greater detail, referring once again to the figures, FIG. 3 is an improved gaming machine 100' in accordance with an exemplary embodiment, and FIG. 4 shows a plurality of improved gaming machines 100' and associated peripherals located on a casino floor and being connected in a network environment in accordance with an exemplary embodiment. The gaming machine 100' of FIG. 3 is like the gaming machine 100 of FIG. 1, except that the gaming machine 100' of FIG. 3 includes a random reward credit meter (RRCM) machine controller 302. The RRCM machine controller 302 may be included in each improved gaming machine 100' and may be in communication with a jackpot controller 204' connected to the network 202. Alternatively, in certain exemplary embodiments, the RRCM machine controller 302 may be located remote from the gaming machines 100' and instead, for example, may be located at elsewhere on the network 202 and be configured to receive signals indicative of coin-in, coin-out, allocations, etc. from the gaming machines 100'. The RRCM machine controller 302 may cause a user interface for random reward customization to be displayed on a display of the gaming machine 100' (e.g., on the main screen 102, the top box 104, the PTM 110, etc.) and also may relay signals between the gaming machine 101' and the jackpot controller 204' Such signals may include, for example, whether the user interface for random reward customization should be displayed, how credits are to be distributed or allocated between the random rewards scenario(s) and the base game(s), whether credits should be credited or debited to the RRCM, etc.

Thus, the RRCM machine controller 302 provides a means to prompt the player once funds (e.g., coins or bills, credit cards, vouchers, or other payment types) are inserted into the machine to designate the bank or credit meter into which the funds should be deposited. The RRCM machine controller 302 thus also satisfies the business goal noted above by providing a means outside of the current techniques intrinsic to the existing logic of the electronic gaming machine system (EGMS) to acquire an "additional coin" (e.g., beyond that which is currently possible, either because of the max bet limitation or because of the inability to designate individual credits apart from base game credits to the random rewards scenario(s)) from the player and to have a means to debit additional funds from a source that the EGMS's programmed logic circuitry otherwise would not be capable of debiting (e.g., once the player selects max bet, which typically automatically causes the gaming machine to enter into play mode).

The RRCM machine controller 302 may be implemented as instructions tangibly stored on a computer-readable storage medium and may be implemented, for example, as any suitable combination of programmed logic circuitry including, for example, hardware, software, firmware, and/or the like. Further details on the configuration and operation of the RRCM machine controller 302 will become clear from the description provided below.

Although a single jackpot controller 204' is shown in FIG. 4, the present invention is not limited to this configuration. For example, one or more separate jackpot controllers may be provided to the network 202, with each said separate jackpot controller being responsible for one of the base game or the random rewards scenario. In the case where a single jackpot controller is implemented, the distribution of functionality may be among separate instances running on the single jackpot controller. Thus, single or multiple improved jackpot controllers 204' may be provided, and/or single or multiple instances may run on a single or multiple improved controllers 204', similar to the techniques as described above.

Figure 5:
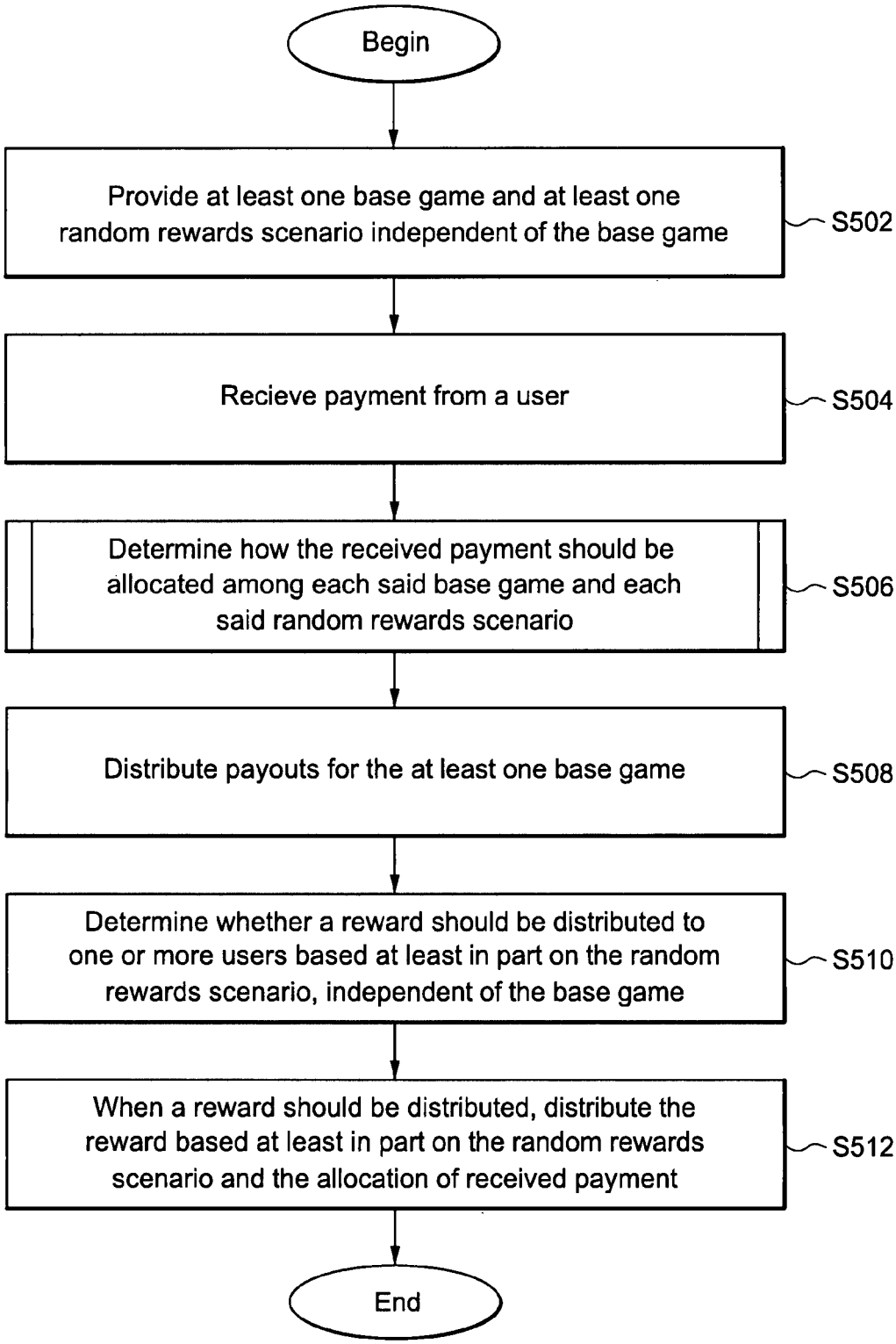
FIG. 5 is an illustrative flowchart showing a process for distributing random rewards via a distinct random rewards credit meter in accordance with an exemplary embodiment.

FIG. 5 is an illustrative flowchart showing a process for distributing random rewards via a distinct random rewards credit meter in accordance with an exemplary embodiment. At least one base game and at least one random rewards scenario independent of the at least one base game are provided in step S502. The at least one base game and the at least one random rewards scenario may be provided on the same or different displays of the gaming machine.

In the process of providing a random rewards scenario, an authorized user (e.g., an agent of the proprietor of the gaming establishment) may create rules. Such rules may specify what or how much to pay, who to pay, and/or when to pay. For example, in the "what or how much to pay" category, the authorized user may specify, for example, an absolute number of credits, various percentages of credits (e.g., to enable payouts according to a paytable), a whole progressive jackpot, percentages of a progressive jackpot, in-kind gifts (e.g., branded goods, vouchers for free services, etc.), and/or the like. In the "who to pay" category, the authorized user may specify, for example, all players participating in the random rewards scenario at a particular time, all players matching predetermined qualification criteria (e.g., when the total amount of credits provided to the particular pool by the player meets or exceeds some predefined threshold, when a player has been playing for a predetermined amount of time, when a player has played a predetermined number of times on the same or different occasions, to the first few players to initiate a bet within a given window of time, etc.), and/or the like. In the "when to pay" category, the authorized user may specify, for example, a fixed time period, when the number of credits in the pool falls within a predetermined range of credits, once a certain number of players have started to play the game, at a predefined event (e.g., within a sporting situation, such as, for example, during baseball playoffs, at quarters within a professional football or basketball game, at various rounds during soccer league play, etc.), and/or the like.

Thus, these criteria or parameters may comprise rules which, in turn, may define various random rewards scenarios. Moreover, the rules may be changed and/or modified in various implementations by authorized users, for example, to increase interest, offer promotions, attract more players, increase revenue, etc. The rules may be specified and/or changed via a configuration interface accessible to authorized users (e.g., via a computer terminal connected to the network 202) configured to access the gaming machines 100', the jackpot controllers 204', and/or the applicable central systems or central systems components.

In step S504, the gaming machine receives payment from a player. Payment may be provided from bills, coins, a credit card, etc. Player ID cards and the like also may be used in connection with certain exemplary embodiments, which may be connected to a database indicating a number of credits for the player, automatically linked to an account, etc.

In step S506, it is determined how the received payment should be allocated among each said base game and each said random rewards scenario. This may be accomplished, for example, using an interface provided on one or more displays, which interface and/or displays may be the same as or different from those of the base game. In brief, the RRCM machine controller may cause a user interface to be displayed on a display of the gaming machine. The particular display may be, for example, the main display 102, the top box 104, the PTM 110, etc. Moreover, the user interface may be provided on a floating layer on one or more the above-described displays as described in, for example, co-pending and commonly-owned application Ser. Nos. 11/889,970 and 11/889,971, the entire content of each of which are hereby incorporated herein by reference.

Then, the player may allocate credits among the base game(s) and/or the random rewards scenario(s). The allocation may be stored and used for subsequent gaming. In certain exemplary embodiments, an RRCM may be maintained and/or displayed in addition to or together with a conventional credit meter, the RRCM being indicative solely of credits allocated to the random rewards scenario(s). Moreover, in certain exemplary embodiments, multiple RRCMs may be provided where there are multiple random rewards scenarios offered for the player.

Still further, where there are multiple random rewards scenarios in which the player may participate, the player may be required to indicate which random rewards pool the player would like to enter. For example, a player may be prompted to select from among pure cash or credit pools that may be fixed jackpots or progressive jackpots, pools of other items (which may be branded products offered, for example, in accordance with the theme of the establishment, the bank of gaming machines in which the player is playing, etc.), combinations thereof, etc.

Also, as a part of this step, a player may specify how credits from the RRCM should be wagered. For example, the player may indicate that credits from the RRCM should be wagered only when the player provides an affirmative indication of such a bet. A player also may indicate that credits from the RRCM should be wagered at least partially automatically (e.g., without direct player involvement with every wager). In such cases, the RRCM machine controller may be instructed to automatically play credits from the RRCM each time a bet for the base game is initiated, each time a max bet on the base game is initiated, until interrupted, etc. The number of credits from the RRCM to be bet also may be specified. For example, the player may specify that a certain absolute number should be wagered, that a percentage of the base bet should be wagered, that a preconfigured maximum should be wagered, etc.

In these and/or other ways, players may, in certain exemplary embodiments, specify both the particular random reward(s) they seek as well as the means by which they seek them, which may include, for example, the betting strategies and resources to commit to trying to "earn" such prizes. In certain exemplary embodiments, it may be possible to specify the means by which random rewards are sought (e.g., when a player is not presented with a list of possible random rewards pools). Further details of the player-configurable techniques for participating in random rewards scenarios will be provided below, for example, in connection with the illustrative displays shown in FIGS. 6-8.

In step S508, payouts are distributed for the at least one base game. This may be accomplished using the rules applicable to each base game provided. In step S510, it is determined whether a reward should be distributed to one or more players based at least in part on the random rewards scenario, independent of the base game. In this step, the rules of each random rewards scenario already defined may be applied. This may be accomplished via a jackpot controller, which in certain exemplary instances may be wholly separate from or a separate instance on the base game jackpot controller, in connection with the RRCM controller meters provided to the respective gaming machines. For example, a random rewards jackpot controller may determine when a random reward should be distributed. Then, using information from the respective RRCM machine controllers (which may be prefetched and/or at least temporarily stored in a computer-readable storage medium accessible by the random rewards jackpot controller, retrieved on-the-fly from the RRCM controller meters, etc.) and applying the predefined rules, the random rewards jackpot controller will determine whether a reward should be distributed.

As a follow-on, in step S512, when a reward should be distributed, the random rewards jackpot controller, in conjunction with the respective RRCM controller meters, will distribute the rewards (or representations of the rewards such as, for example, receipts or coupons for redemption at a mall, store, within the gaming location, etc.; codes for player tracking cards to indicate that an award should be provided to the user; by signaling to the location's personnel that a reward should be distributed; etc.), based at least in part on the random rewards scenario and the allocation of the received payments. It will be appreciated that when credits are wagered or earned, they are debited from or credited to the appropriate credit meter. Later, such credits may or may not be redistributed among and/or between the various credit meters.

In certain exemplary embodiments, once a player receives a non-credit random reward, the RRCM machine controller may present the player with an option to put these funds or some equivalent thereof into the RRCM and thus at risk. The value of the non-credit random reward may be presented to the player in certain exemplary implementations. However, in certain other exemplary implementations, the value of the non-credit random reward either may be concealed from the player or may be randomly generated. In the latter case, the payout may be higher or lower than the actual value of the non-credit random reward. This "concealed" exchange payout may be generated in any number of ways, for example, randomly, according to a paytable, based on characteristics of the player (e.g., more highly valued players receive better awards or better chances of receiving better awards), etc. In still other alternative exemplary implementations, the payout may not be in credits. Rather, another in-kind prize may be offered, again which may be known or unknown to the player, and again which may be of greater or lesser value.

Figure 6:
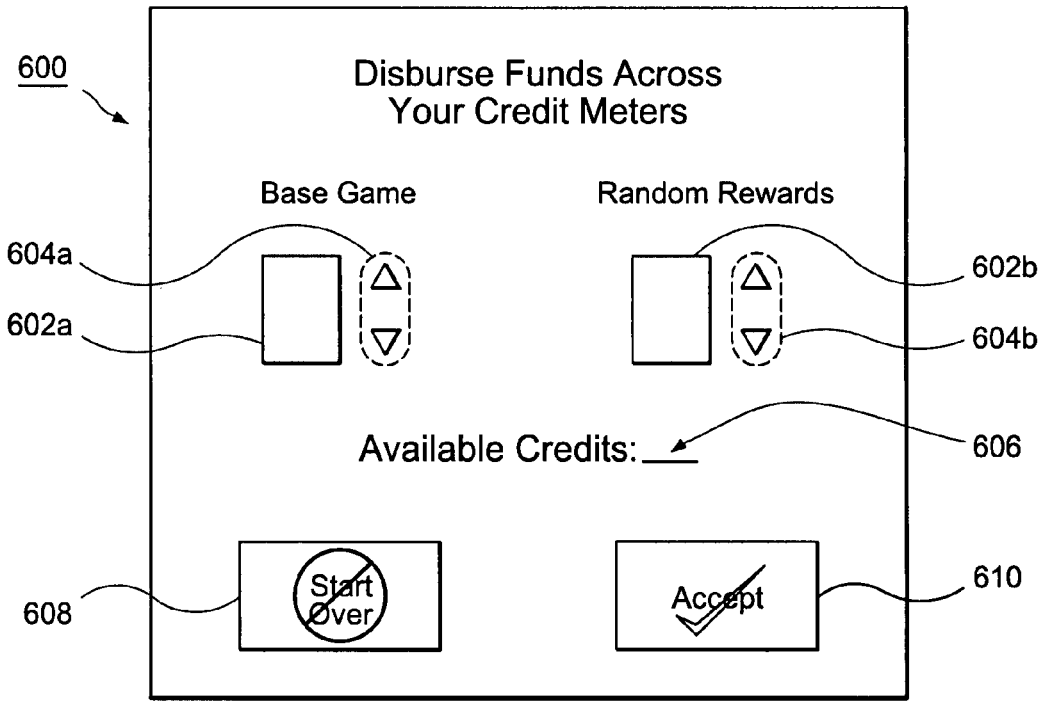
FIG. 6 is an illustrative display for distributing credits across a plurality of credit meters in accordance with an exemplary embodiment.

FIG. 6 is an illustrative display 600 for distributing credits across a plurality of credit meters in accordance with an exemplary embodiment. After or as a player inserts credits, the total number of available credits for allocation may be displayed in the available credits display area 606. Then, the player may use the base game credit adjustment interface 604*a* or the random rewards credit adjustment interface 604*b* to respectively change the number of credits allocated to the base game and the random rewards scenario. As the player uses the base game credit adjustment interface 604*a* and/or the random rewards credit adjustment interface 604*b*, the base game credit allocation display 602*a* and the random rewards allocation display 602*b* are updated, accordingly. The number of available credits shown in the available credits display area 606 also may be adjusted accordingly. The player may confirm the allocation is correct and proceed, e.g., with gaming, by selecting the accept button 610. Alternatively, the player may initiate a new allocation or even stop playing the game in certain exemplary embodiments by selecting the start over button 608.

The base game credit allocation display 602*a* and the random rewards allocation display 602*b* may form the starting allocation for the base game credit meter (BGCM) and the RRCM. Either or both of the BGCM and the RRCM may be displayed to the player during game play (e.g., on the base display, on the top box, on the PTM, as a floating layer, etc.).

By specifying the number of credits to dedicate to the RRCM, the player enables the gaming operator to reach credits from a second meter not otherwise available using conventional machines. That is, as noted above, current random rewards systems effectively skim a credit off of the base game credits wagered. However, the techniques of certain exemplary embodiments enable simultaneous play of multiple games using separate (or at least separated) credit meters, also enabling a player to wager—and a gaming operator to collect—more credits than otherwise would be allowed by merely using the gaming machine itself, all through a player opt-in interface.

When a single random rewards scenario is offered to the players, an initial allocation of credits between the BGCM and the RRCM, e.g., via the illustrative display 600 may conclude the opt-in process of a player configuring his gaming environment. Also, in certain exemplary embodiments, when multiple random rewards scenarios are offered, the player sometimes may not be able to further configure gaming preferences. In such cases, the random rewards machine controller may direct all wagers from the RRCM to be distributed evenly between random rewards scenarios or in accordance with some predefined schema. By way of example and without limitation, in a case where there are two random rewards scenarios provided including a premium random rewards scenario and a basic random rewards scenario, more credits may be dedicated to the premium random rewards scenario than to the basic random rewards scenario.

As alluded to above, in certain other exemplary embodiments, the player may be able to further configure gaming preferences. This may include, for example, the ability to specify either or both of the random rewards scenarios to participate in and the amount to dedicate to each random rewards scenario available to the player. These possibilities are explained in greater detail below with reference, for example, to FIGS. 7 and 8.

Figure 7:
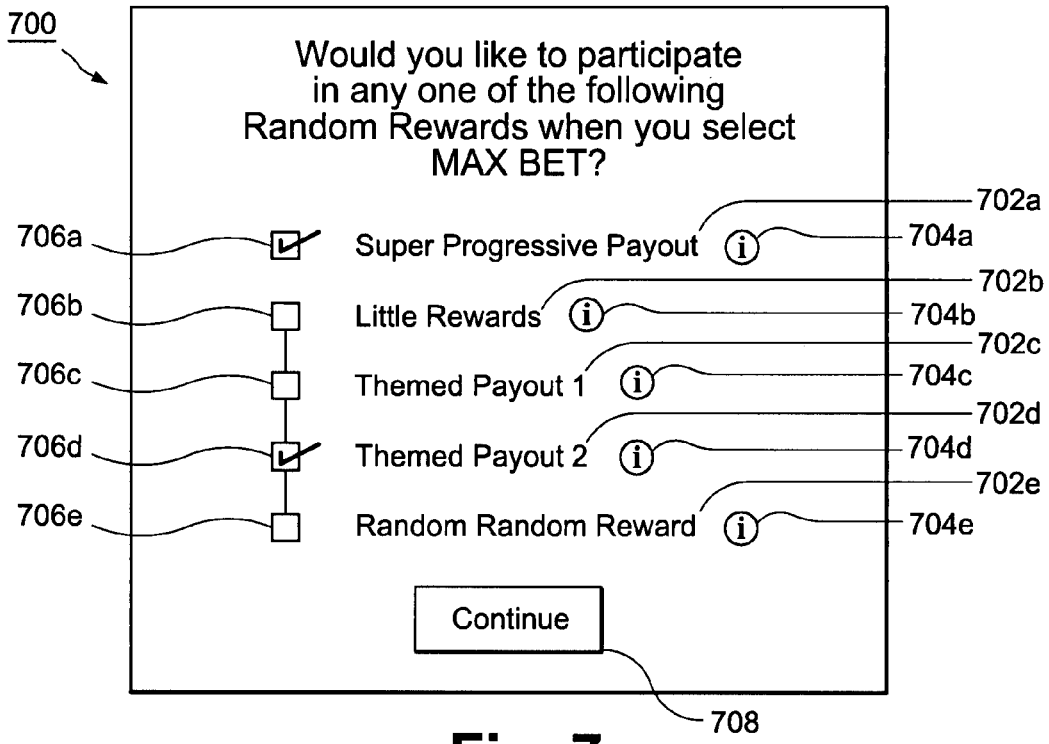
FIG. 7 is an illustrative display for selecting from among a plurality of exemplary random rewards pools in accordance with an exemplary embodiment.

FIG. 7 is an illustrative display 700 for selecting from among a plurality of exemplary random rewards pools in accordance with an exemplary embodiment. Thus, the display 700 in FIG. 7 enables players to choose the particular random rewards pool(s) they would like to receive. Titles 702*a-e* of the various random rewards scenarios are provided for the player to select from. A player may opt-in to a particular random rewards pool by selecting a corresponding checkbox 706*a-e*.

In addition, optionally, informational icons 704*a-e* may enable a player to view additional detail and/or further customize a particular random rewards scenario. Additional information may include, for example, chances of winning; predetermined payout amounts, times, tables, criteria, etc.; and/or any other rules, features, or aspects associated with the particular random rewards scenario selected. Further customization may include, for example, when to participate in a particular random rewards scenario (e.g., each time a bet is made, each time a max bet is made, only upon a player indication, etc.), how much to participate in a particular random rewards scenario, etc.

A player may continue (e.g., on to game play and/or further customization) by selecting button 708.

As the illustrative titles in FIG. 7 suggest, the random rewards may be of varying types. For example, the random rewards scenarios offered may include progressive-based rewards, fixed jackpots, themed payouts, in-kind payouts, "random" random rewards, etc. Also, the list of random rewards scenarios may be provided in advance by an authorized user and/or may be provided according to predefined rules. For example, the random rewards machine controller and/or the random rewards jackpot controller may determine whether a player at a particular gaming machine meets certain predefined criteria. Based on that determination, the number and type of random rewards may be varied. For example, premium and/or better chance random rewards scenarios may be provided to more highly valued or frequent customers, theme-based random rewards may be presented to those known to match a certain demographic profile (e.g., sports-based in-kind rewards to 25-35 year-old males, handbag-based in-kind rewards to females who shop at known stores, tickets to those who have attended many shows at the gaming location, etc.), and/or the like.

Figure 8:
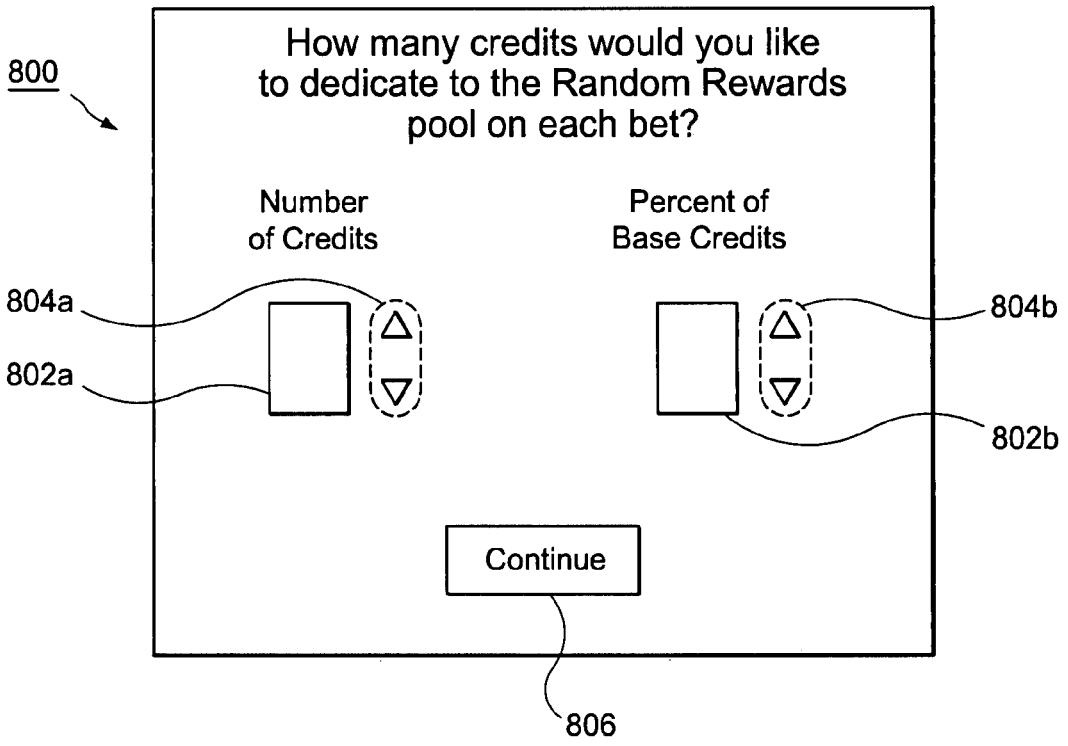
FIG. 8 is an illustrative display for specifying a number of credits to dedicate to a random rewards pool per bet, in accordance with an exemplary embodiment.

In certain exemplary embodiments, the player may specify a number of credits to automatically dedicate to a random rewards pool on each bet. Thus, FIG. 8 is an illustrative display 800 for specifying a number of credits to dedicate to a random rewards pool per bet, in accordance with an exemplary embodiment. The number of credits indicator 802*a* and the corresponding adjuster 804*a* enables the player to dedicate a fixed number of credits to the random rewards pool from the RRCM on each bet automatically (e.g., without further direct player input). Similarly, the percent credits indicator 802*b* and the corresponding adjuster 804*b* enables the player to dedicate a number of credits to the random rewards pool from the RRCM on each bet automatically, with the number being based on the specified percentage of the base credits. The player may accept the selection (e.g., and continue to play the game) by selecting button 806.

The display 800 of FIG. 8 may be used by a player for initial setup of the RRCM. It also may be used by the player to subsequently change the amount of the contribution from the RRCM during the course of game play. Furthermore, although only one set of indicators 802*a-b* and adjusters 804*a-b* are shown in FIG. 8, it will be appreciated that the present invention is not so limited. For example, when multiple random rewards scenarios are provided to, and optionally selected by, the player, additional indicators 802 and corresponding adjusters 804 may be provided for the play to further customize the gaming experience.

Figure 9:
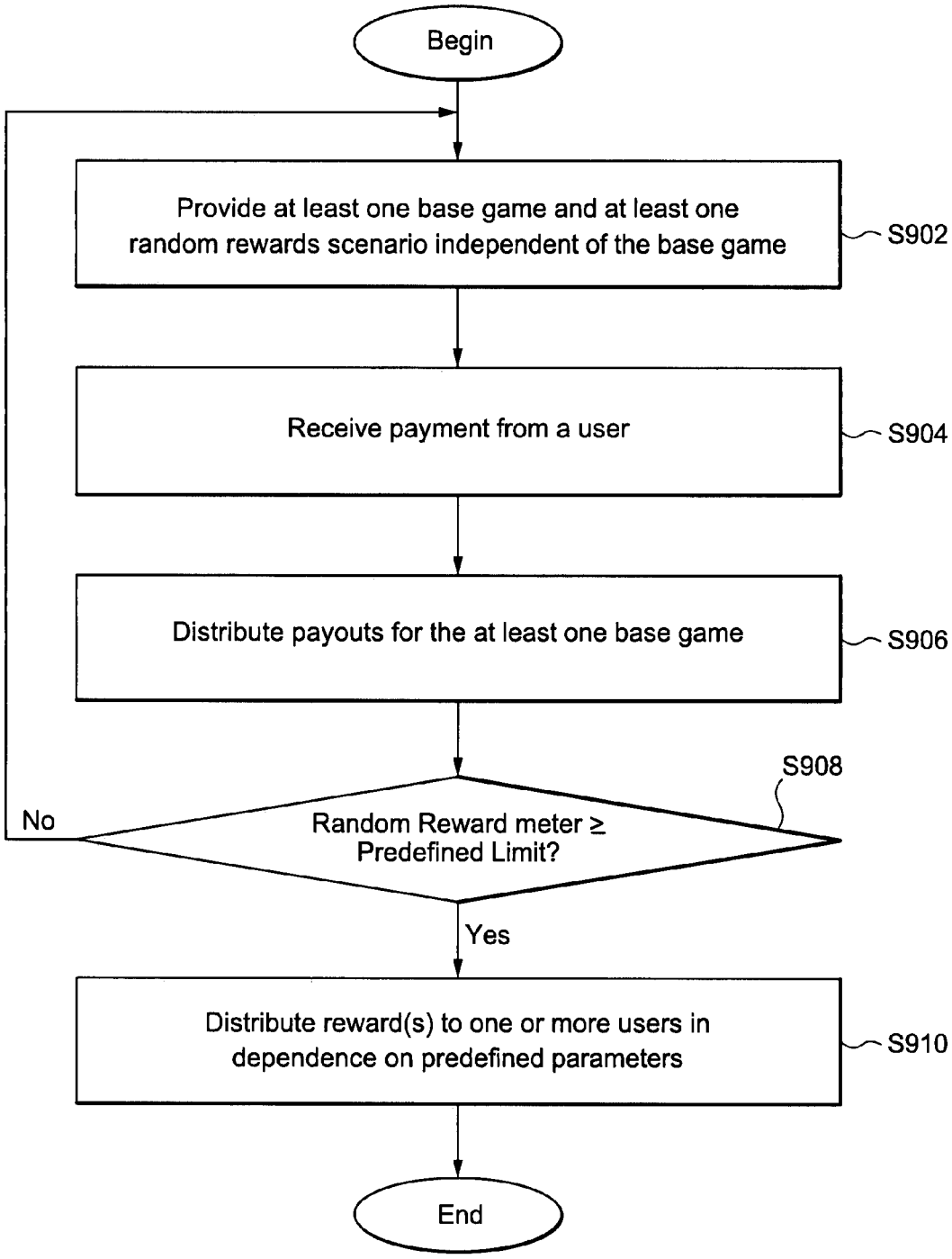
FIG. 9 is an illustrative flowchart showing a process for distributing random rewards once a random rewards meter meets or exceeds a predefined limit, in accordance with an exemplary embodiment.
Figure 10:
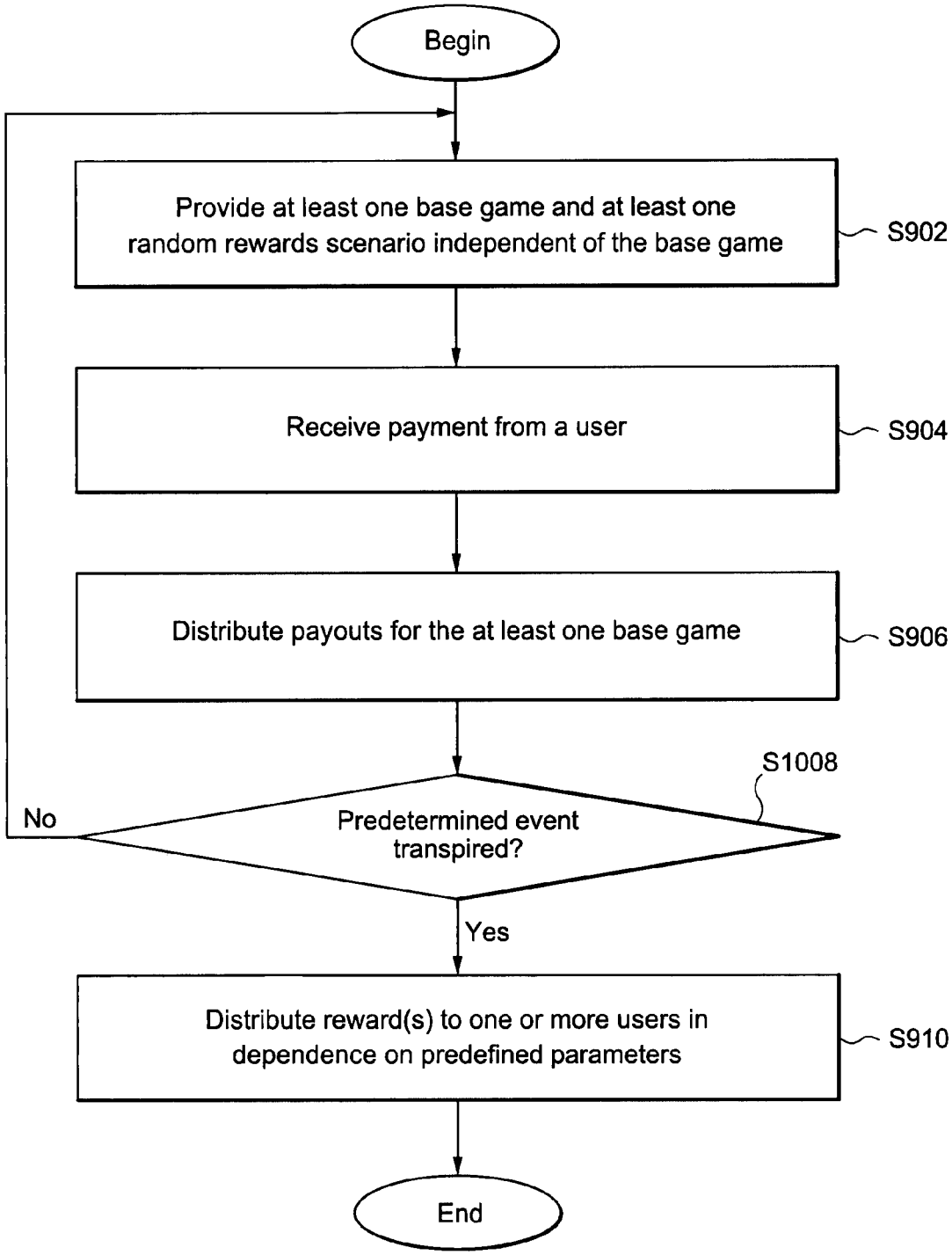
FIG. 10 is an illustrative flowchart showing a process for distributing random rewards once a predetermined event has transpired, in accordance with an exemplary embodiment.
Figure 11:
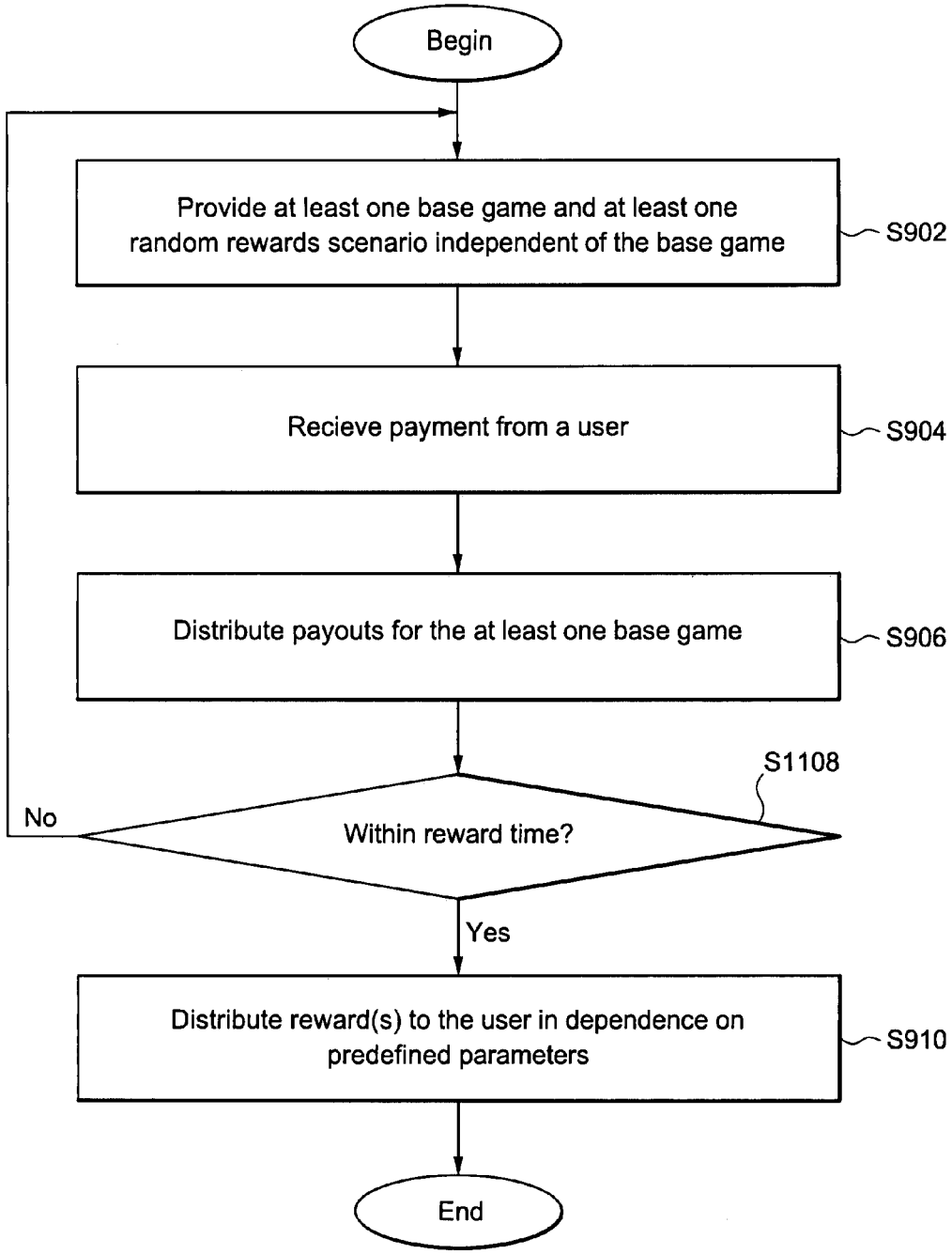
FIG. 11 is an illustrative flowchart showing a process for distributing random rewards within a defined reward time, in accordance with an exemplary embodiment.

FIGS. 9-11 are illustrative flowcharts demonstrating when certain exemplary payouts may be provided to players. More particularly, FIG. 9 is an illustrative flowchart showing a process for distributing random rewards once a random rewards meter meets or exceeds a predefined limit, in accordance with an exemplary embodiment; FIG. 10 is an illustrative flowchart showing a process for distributing random rewards once a predetermined event has transpired, in accordance with an exemplary embodiment; and FIG. 11 is an illustrative flowchart showing a process for distributing random rewards within a defined reward time, in accordance with an exemplary embodiment.

In each of FIGS. 9-11, similar to steps S502, S504, and S508 in FIG. 5, steps S902, S904, and S906 respectively provide at least one base game and at least one random rewards scenario independent of the base game, receive payment from a player, and distribute payouts for the at least one base game in dependence on the rules of the base game.

In step S908 in FIG. 9, it is determined whether the random rewards meter (e.g., stored on a random rewards jackpot controller and updatable by the individual gaming machines via, for example, the RRCM machine controllers respectively provided thereto) meets or exceeds a predefined limit. Differently stated, it is determined whether the credits contributed by players from their respective RRCMs exceeds a threshold number of credits (e.g., 100, 1000, 10000, 25000, etc. credits).

In step S1008 in FIG. 10, it is determined whether a predetermined event has transpired. A predetermined event may include, for example, a particular sports-related activity (a quarter or period within a game, a berth to a particular playoff round, etc.), a holiday, a title bout, etc. This approach may be applied, for example, to sports and race betting. For example, a player may elect to participate by paying an extra credit to fund the applicable random rewards pool. Ultimately, the pool will be equally disbursed to qualified players at a particular stage within that sporting event (e.g., in a baseball playoffs example, 10% may be awarded for the first game, 10% for the second game, etc.).

In step S1108 in FIG. 11, it is determined whether the time is within a predefined reward timeframe. That is, rewards may be distributed at a certain time (e.g., at 9 pm) and/or for a certain time interval (e.g., 5 minutes, 10 minutes, etc.). Also, rewards may only be granted to players who have been playing for a predetermined amount of time (e.g., 5 minutes, 10 minutes, etc.), rather than giving something away right away. A qualifying threshold may thus be set to spur at least some game play.

Any or all of the payout criteria described with reference to steps S908, S1008, and S1108 may be used alone or in combination with any of the other steps and/or other steps not described herein. Thus, for example, steps S908 and S1108 may be combined to create a rule whereby random rewards are distributed when a certain credit threshold is met or exceeded, but random rewards credits are only distributed for a predetermined amount of time. This and/or other rules may help to create a frenzy to attract players to gaming machines more quickly to try to earn rewards. To further facilitate this, overhead displays may be leveraged to display the existence and/or distribution of such awards before and/or during such awards. Further details of the distribution also may be presented, such as, for example, time left for distribution, total amount distributed, amount left to be distributed, top recipients, etc.

In each of FIGS. 9-11, one or more rewards will be distributed to one or more players in dependence on predefined parameters in step S908. Such parameters may be predefined and configurable by, for example, authorized personnel of the gaming location. For example, rewards may be provided to all those who qualify equally, across the board. For example, 25% may be provided to everyone who qualifies on the first game pull, 10% on the second game pull, etc., until all of the credits are disbursed.

It will be appreciated that although this is one example of payout parameters, the present invention is not limited thereto. For example, in certain exemplary embodiments, the prize pool division need not be distributed equally. For example, a first player may get the largest reward (e.g., 25%), a second player may get a second largest reward (e.g., 10%), etc. Thus, a predefined number of individual random rewards may be generated. In certain exemplary embodiments, the number of individual random rewards generated may be the number of qualified players when the event started. The weighting on the prizes may in certain exemplary implementations be structured like a paytable, where the average prize size may be configured.

Figure 12:
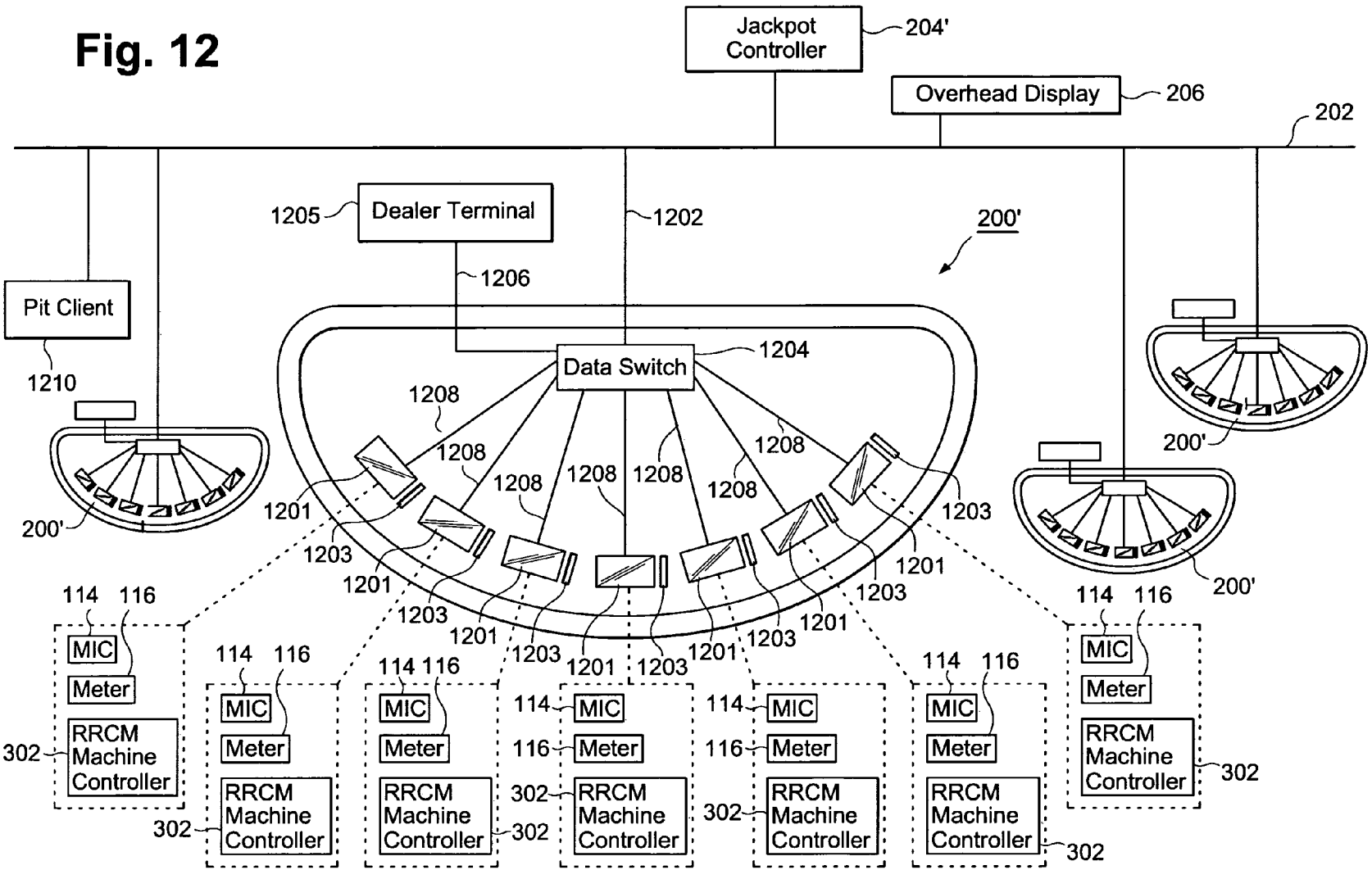
FIG. 12 shows a plurality of improved table games being located on a casino floor and being connected in an improved networked environment in accordance with an exemplary embodiment.

It will be appreciated that similar techniques may be applied to table games. For example, FIG. 12 shows a plurality of improved table games 200' being located on a casino floor and being connected in an improved networked environment in accordance with an exemplary embodiment. In FIG. 12, each improved table 200' has a number of player positions. More particularly, seven player positions are shown, as this is the customary number of player positions at blackjack tables, for example. Of course, the invention is not limited to a particular number of player positions or to any particular table game.

Each player position includes a display 1201 and a payment acceptor and/or card reader 1203 (similar to the payment acceptor 108 described above). The player may have the ability to place side wagers and/or a main wager via the interface offered by the display 1201. Also, each display 1201 also may show the illustrative displays of FIGS. 6-8. In general, each display 1201 enables the player at that player position to, for example, allocate credits among the BGCM and the RRCM as described above. Each player position also includes a MIC 114, an in-table meter 116, and RRCM machine controller 302, similar to the components described above with relation to FIG. 3. These components are not shown at every table 200' for the sake of readability of FIG. 12.

There also is a dealer terminal 1205 provided to each table. The dealer terminal 1205 includes a player representation and a keypad. The dealer may use the dealer terminal to make player credits/debits, retrieve the status of any player (e.g., amount of credits, whether the player is a preferred patron, etc.), and the like. For example, the dealer may designate a player in the player representation and indicate, via the keypad, whether to credit/debit the player's account, what the player's hand included, etc.

Data may be logged (e.g., to one or more databases of the central servers) during and/or after the play of each player.

A connection 1202 is provided to each table 200' from the network 202 so as to connect each respective table 200' to, for example, the central systems (not shown) and the jackpot controller 204' via a data switch 1204. Via connection 1206, the data switch connects the dealer terminal 1205 to the network 202. Similarly, via connection 1208, the data switch 1204 connects each of the player positions to the network 202.

In certain exemplary embodiments, each table 200' will have its own associated data switch 1204. In such exemplary instances, the network 202 may be kept more "flat" and thus network latencies may be decreased. However, in certain other exemplary embodiments, the player positions and the dealer terminal may be directly addressable across the network 202.

A pit client 1210 also sits on the network 202. A pit, or area of table games within a casino, typically comprises 2-12 such tables. There may be multiple pits within a single casino. One or two pit bosses typically are assigned to a pit. In place of or in addition to pit bosses, the pit client 1210, via its connection to the central systems 202 and to the tables individually, may provide substantially real-time player ratings. These player ratings may be actual, rather than merely estimated, ratings. In addition to actual and substantially real-time ratings, actual substantially real-time player and table accountings may be gathered. Moreover, promotional and/or contributional bonusing may be provided based on an individual's identity, an individual player's rating, on a particular table's action, on the action within a pit, on a property-wide basis, according to a multi-property basis, etc. Similarly, random rewards may be distributed on the same and/or other categories in place of, or in addition to, the player opt-in techniques described above in relation to the gaming machine exemplary embodiments.

Although a single jackpot controller 204' is shown on the network, the present invention is not so limited. For example, a jackpot controller 204' or an instance of a jackpot controller 204' may be provided to each pit.

Figure 13:
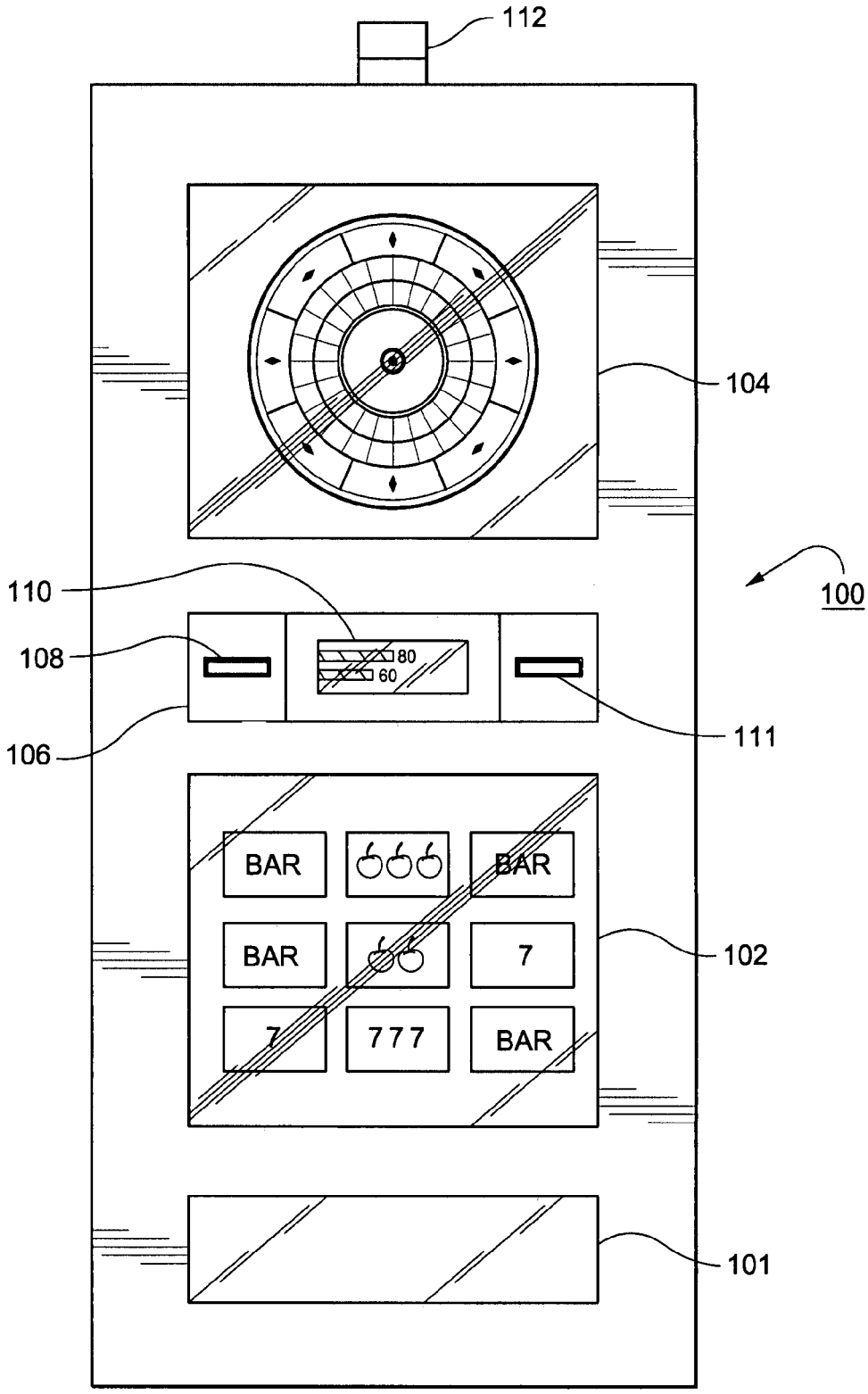
FIG. 13 shows an improved gaming machine displaying an illustrative base game, bonus game, and two credit meters, in accordance with an exemplary embodiment.

FIG. 13 shows an improved gaming machine displaying an illustrative base game, bonus game, and two credit meters, in accordance with an exemplary embodiment. In FIG. 13, a slot machine type game is playable via main screen 102 as an exemplary base game. A roulette based bonus game is playable via top box 104 as an exemplary bonus game that may, for example, become active based on the play of the base game. On PTM 110, two meters and digital credit numbers are shown by way of example. A first meter and first credit number corresponds to the BGCM, and a second meter and second credit number corresponds to the RRCM. It will be appreciated that the types of games, locations, displays, etc., described in relation to FIG. 13 are provided by way of example and without limitation. Additionally, it will be appreciated that the types of meters and their locations, displays, etc., described in relation to FIG. 13 are provided by way of example and without limitation.

Figure 14:
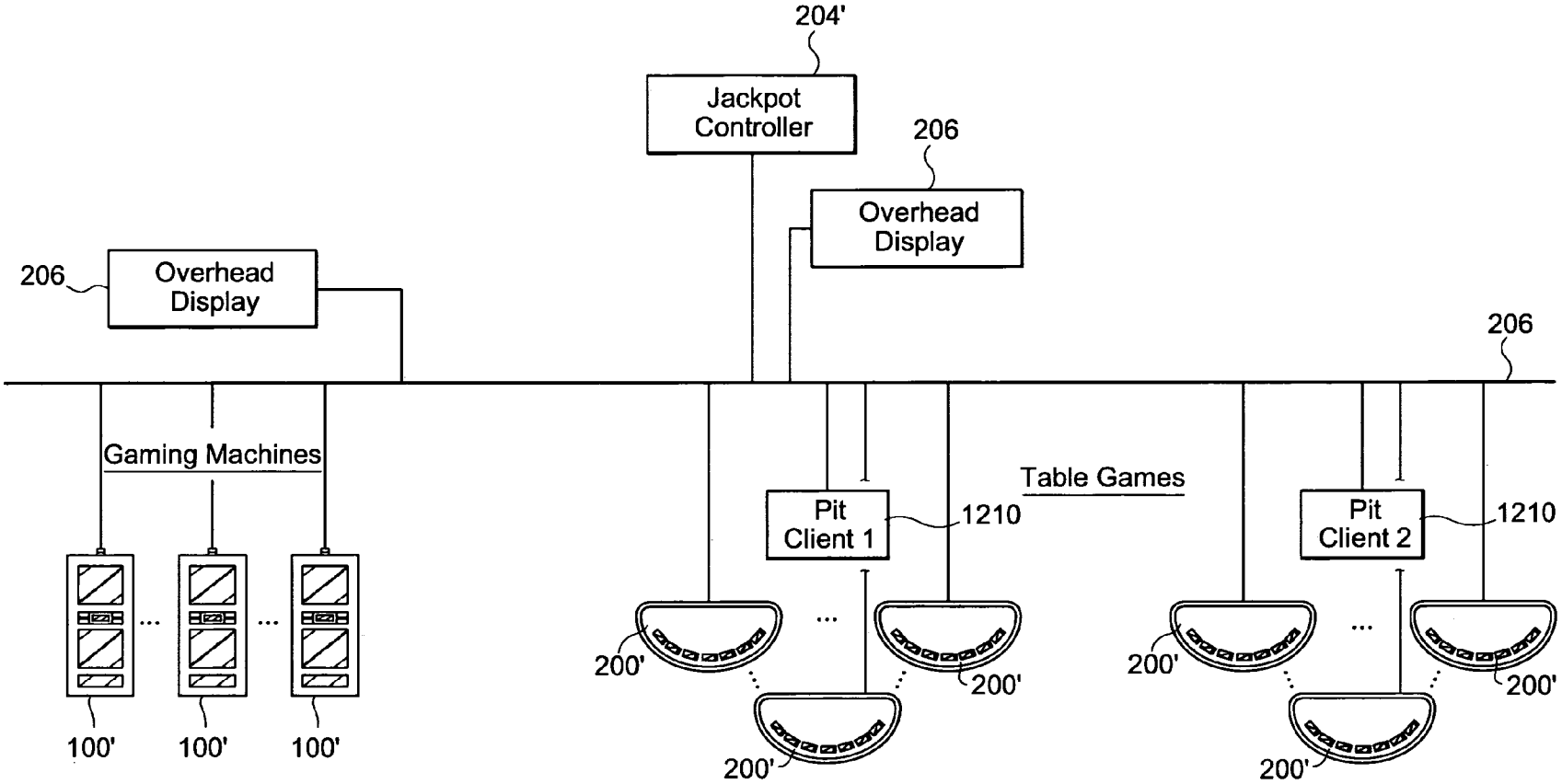
FIG. 14 is a partial schematic view of a casino floor including connections to improved gaming machines and improved table games in accordance with an exemplary embodiment.

FIG. 14 is a partial schematic view of a casino floor including connections to improved gaming machines 100' and improved table games 200' in accordance with an exemplary embodiment. The improved gaming machines 100' and improved table games 200' are, of course, connected to the network 202. The table games 200' may be divided into one or more pits, as is conventional.

Figure 15:
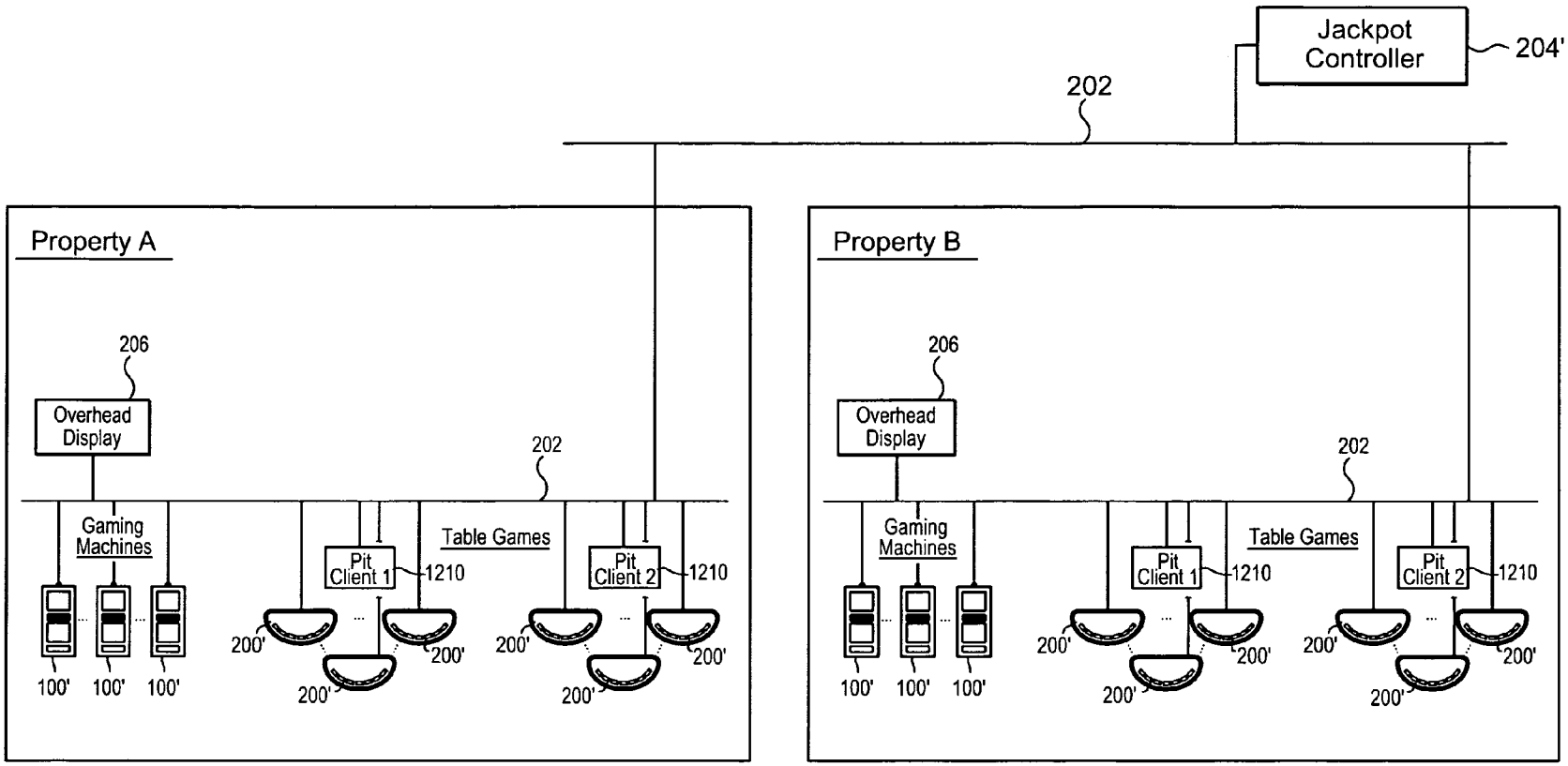
FIG. 15 is an illustrative multi-property layout of improved gaming machines and improved table games in accordance with an exemplary embodiment.

FIG. 15 is an illustrative multi-property layout of improved gaming machines and improved table games in accordance with an exemplary embodiment. In certain exemplary embodiments, some or all of the above-described features may be provided across multiple properties. Thus, for example, random rewards scenarios and/or pools may be defined across multiple properties. Thus, one or more jackpot controllers 204' may be provided for multiple properties to share.

It will be appreciated that in certain exemplary embodiments, random rewards may be awarded within smaller areas in a single casino. The smaller areas may include, for example, one or more pits, one or more banks of gaming machines, and/or any combination thereof, etc.

Although certain exemplary embodiments have been described as relating to gaming machines and table games in casinos, it will be appreciated that the present invention is not so limited. For example, the exemplary embodiments described herein may be used in connection with casinos, riverboats, restaurants, hotels, etc. Also, it will be appreciated that similar to the application of the player opt-in techniques described in relation to gaming machines and/or table games, certain exemplary embodiments may be applied to other gaming devices including, for example, roulette tables, craps tables, etc.

It will be appreciated that although the exemplary embodiments have been described in relation to a second credit meter being tied to a random rewards scenario, the present invention is not so limited. Indeed, a second credit meter could be provided for any game, good, service, feature, or the like, apart from or related to the base game. For example, a second credit meter could be tied to a secondary service offering, such as, for example, a separate game that plays simultaneously with the base game, other wagers (such as, for example, race and/or sports-based wagers), hotel services (e.g., room reservations, room service, etc.), tickets to shows or events, restaurants, stores, etc. Thus, certain exemplary embodiments provide techniques for controlling and/or managing multiple credit meters, with each meter being tied to a discrete or independent purpose. The credits may or may not be transferable between meters in certain exemplary embodiments.

Also, the exemplary features, aspects, and advantages described herein may be combined in yet further ways to achieve further embodiments.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A gaming device for use in a networked gaming environment, the networked gaming environment including a jackpot controller configured to calculate and disburse payouts for a base game playable by the gaming device and a random rewards jackpot controller configured to calculate and disburse payouts for at least one predefined random rewards scenario available to the gaming device, said gaming device comprising:

at least one display configured to display a base game provided to the gaming device;

a payment acceptor configured to receive a form of payment from a player in exchange for credits usable on the gaming device; and a random rewards machine controller configured to enable the player to allocate credits between a base game credit meter and a random rewards credit meter, the base game credit meter representing credits usable in connection with the base game and the random rewards credit meter representing credits usable in connection with at least one random rewards pool corresponding to one said random rewards scenario, wherein the at least one random rewards scenario is independent of the base game, wherein a number of credits contributable to the base game from the base game credit meter is independent of a number of credits contributable to the at least one random rewards scenario from the random rewards credit meter, and wherein payouts for the at least one random rewards scenario are disbursable independent of payouts for the base game.

2. The gaming device of claim 1, wherein the random rewards jackpot controller is configured to provide a plurality of random rewards scenarios.

3. The gaming device of claim 2, wherein the random rewards machine controller is further configured to cause a user interface to be displayed to the player to enable the player to select which random rewards scenarios out of the plurality of random rewards scenarios to participate in.

4. The gaming device of claim 2, wherein the random rewards machine controller is further configured to cause a user interface to be displayed to the player to enable the player to specify a number of credits from the random rewards credit meter to allocate to each random rewards scenarios in the plurality of random rewards scenarios.

5. The gaming device of claim 1, wherein the random rewards machine controller is further configured to cause a user interface to be displayed to the player to enable the player to define a customizable rule as to how credits from the random rewards credit meter are to be contributed to the at least one random rewards scenario.

6. The gaming device of claim 5, wherein the rule is that credits from the random rewards credit meter are to be contributed to the at least one random rewards scenario automatically each time the player initiates a bet on the base game.

7. The gaming device of claim 6, wherein the rule is that credits from the random rewards credit meter are to be contributed to the at least one random rewards scenario automatically each time the player initiates a bet on the base game via a max bet feature provided in connection with the base game.

8. The gaming device of claim 5, wherein the rule is that a player-specified fixed number of credits are to be contributed to the at least one random rewards scenario from the random rewards credit meter.

9. The gaming device of claim 5, wherein the rule is that a player-specified fixed percentage of credits wagered on the base game are to be contributed to the at least one random rewards scenario from the random rewards credit meter.

10. The gaming device of claim 1, wherein the gaming device is a gaming machine or a table game.

11. A method of playing a gaming device connected in a networked gaming environment, the method comprising:

providing a base game playable by the gaming device, the base game being configured to award credits to the gaming device in dependence on a signal received from a jackpot controller connected in the networked gaming environment;

providing at least one random rewards scenario enterable by the gaming device, the at least one random rewards scenario being configured to award credits to the gaming device in dependence on a signal received from a random rewards jackpot controller connected to the networked gaming environment;

displaying the base game on a display of the gaming device;

receiving a form of payment from a payment acceptor in exchange for credits usable on the gaming device;

allocating credits between a base game credit meter and a random rewards credit meter in dependence on input received from a player of the gaming device, the base game credit meter representing credits usable in connection with the base game and the random rewards credit meter representing credits to be contributed to at least one random rewards pool corresponding to one said random rewards scenario, wherein the at least one random rewards scenario is independent of the base game, wherein a number of credits contributable to the base game from the base game credit meter is independent of a number of credits contributable to the at least one random rewards scenario from the random rewards credit meter, and wherein payouts for the at least one random rewards scenario are disbursable independent of payouts for the base game.

12. The method of claim 11, further comprising providing a plurality of random rewards scenarios.

13. The method of claim 12, further comprising designating which random rewards scenarios out of the plurality of random rewards scenarios to participate in in response to input received from the player.

14. The method of claim 12, further comprising specifying a number of credits from the random rewards credit meter to allocate to each said random rewards scenario in the plurality of random rewards scenarios in response to input received from the player.

15. The method of claim 11, further comprising defining a rule as to how credits from the random rewards credit meter are to be contributed to the at least one random rewards scenario in response to input received from the player.

16. The method of claim 15, further comprising automatically contributing credits to the at least one random rewards scenario each time the player initiates a bet on the base game.

17. The method of claim 16, further comprising automatically contributing credits from the random rewards credit meter to the at least one random rewards scenario each time the player initiates a bet on the base game via a max bet feature provided in connection with the base game.

18. The method of claim 15, further comprising contributing a player-specified fixed number of credits to the at least one random rewards scenario from the random rewards credit meter.

19. The method of claim 15, further comprising contributing a player-specified fixed percentage of credits wagered on the base game to the at least one random rewards scenario from the random rewards credit meter.

20. The method of claim 11, further comprising defining what or how much to pay, whom to pay, and/or when to pay a payout in connection with each said random rewards scenario.

21. A networked gaming system, comprising:

a plurality of gaming devices comprising gaming machines and/or table games;

a jackpot controller configured to calculate and disburse payouts for a base game playable by at least some of the gaming devices; and a random rewards jackpot controller configured to calculate and disburse payouts for at least one predefined random rewards scenario available to at least some of the gaming devices, wherein payouts for the at least one random rewards scenario are disbursable independent of payouts for the base game, and wherein each said gaming device comprises:

at least one display configured to display a base game provided to the gaming device, a payment acceptor configured to receive a form of payment from a player in exchange for credits usable on the gaming device, and a random rewards machine controller configured to enable the player of the gaming device to allocate credits between a base game credit meter and a random rewards credit meter, the base game credit meter representing credits usable in connection with the base game and the random rewards credit meter representing credits usable in connection with at least one random rewards pool corresponding to one said random rewards scenario, wherein the at least one random rewards scenario is independent of the base game, and wherein a number of credits contributable to the respective base game from the base game credit meter is independent of a number of credits contributable to the at least one random rewards scenario from the random rewards credit meter.

22. A gaming device for use in a networked gaming environment, the networked gaming environment including a jackpot controller configured to calculate and disburse payouts for a base game playable by the gaming device and a random rewards jackpot controller configured to calculate and disburse payouts for at least one predefined random rewards scenario available to the gaming device, said gaming device comprising:

at least one display configured to display a base game provided to the gaming device;

a payment acceptor configured to receive a form of payment from a player in exchange for credits usable on the gaming device; and wherein a random rewards machine controller provided to the network is configured to allocate credits between a base game credit meter and a random rewards credit meter on behalf of a player, the base game credit meter representing credits usable in connection with the base game and the random rewards credit meter representing credits usable in connection with at least one random rewards pool corresponding to one said random rewards scenario, wherein the at least one random rewards scenario is independent of the base game, wherein a number of credits contributable to the base game from the base game credit meter is independent of a number of credits contributable to the at least one random rewards scenario from the random rewards credit meter, and wherein payouts for the at least one random rewards scenario are disbursable independent of payouts for the base game.

23. A method of managing a plurality of credit meters provided to a gaming device, the method comprising:

providing a first credit meter, said first credit meter being configured to provide credits to a base game playable via the gaming device;

defining at least one secondary service accessible via the gaming device;

providing at least one second credit meter, each said second credit meter being associated with one said secondary service such that a secondary service is fundable with credits only from its respective second credit meter; and distributing credits among the plurality of credit meters based on patron input to the gaming device.

24. A gaming device capable of implementing the method of claim 23.

* * * * *